US007427128B2

(12) United States Patent
Hayasaki et al.

(10) Patent No.: US 7,427,128 B2
(45) Date of Patent: Sep. 23, 2008

(54) LIQUID CONTAINER, LIQUID SUPPLY SYSTEM AND PRINTING DEVICE USING LIQUID CONTAINER, AND CIRCUIT BOARD FOR LIQUID CONTAINER

(75) Inventors: Kimiyuki Hayasaki, Yokohama (JP); Kenjiro Watanabe, Ohta-ku (JP); Nobuyuki Hatasa, Kawasaki (JP); Tatsuhiko Yamazaki, Zama (JP)

(73) Assignee: Canon Kabushiki Kaisha, Tokyo (JP)

( * ) Notice: Subject to any disclaimer, the term of this patent is extended or adjusted under 35 U.S.C. 154(b) by 321 days.

(21) Appl. No.: 11/305,271

(22) Filed: Dec. 19, 2005

(65) Prior Publication Data

US 2006/0244795 A1 Nov. 2, 2006

(30) Foreign Application Priority Data

Dec. 24, 2004 (JP) ..... 2004-374487

(51) Int. Cl.
*B41J 2/175* (2006.01)
*B41J 29/393* (2006.01)

(52) U.S. Cl. ..... 347/86; 347/87; 347/19

(58) Field of Classification Search ..... 347/84, 347/85, 86, 87, 19
See application file for complete search history.

(56) References Cited

U.S. PATENT DOCUMENTS 5,049,898 A * 9/1991 Arthur et al. ..... 347/19
5,583,549 A 12/1996 Ujita et al. ..... 347/86
5,610,635 A * 3/1997 Murray et al. ..... 347/7
5,788,388 A * 8/1998 Cowger et al. ..... 347/7
5,812,156 A * 9/1998 Bullock et al. ..... 347/19
5,860,363 A * 1/1999 Childers et al. ..... 347/7
5,940,102 A 8/1999 Watanabe et al. ..... 347/86
6,126,265 A * 10/2000 Childers et al. ..... 347/23
6,170,939 B1 1/2001 Ujita et al. ..... 347/86
6,196,670 B1 * 3/2001 Saruta ..... 347/86
6,371,586 B1 * 4/2002 Saruta ..... 347/7
6,422,675 B1 * 7/2002 Tomomatsu ..... 347/7
6,431,681 B2 8/2002 Hatasa et al. ..... 347/19

(Continued)

FOREIGN PATENT DOCUMENTS

CN 1488509 A 4/2004

(Continued)

*Primary Examiner*—Stephen D Meier
*Assistant Examiner*—Rene Garcia, Jr.
(74) *Attorney, Agent, or Firm*—Fitzpatrick, Cella, Harper & Scinto

(57) ABSTRACT

An ink tank detachably mounted on a printer includes a non-volatile memory and a LED for executing a process in response to a condition of the tank such as ink residual quantity by transmitting information stored in the memory to a printer, and informing the condition of the ink by use of the LED. Further, the content stored in the memory is prevented from being destroyed, and the LED can perform light emission until immediately before detachment and thus contribute to improvement in workability of a user. A volatile memory element is provided in addition to the non-volatile memory. When a user can detach the tank, condition information on the ink tank retained by the non-volatile memory is transferred to the volatile memory in advance. When it is possible to detach the tank, control for turning the LED on and off is achieved by accessing only to the volatile memory.

20 Claims, 30 Drawing Sheets

U.S. PATENT DOCUMENTS

| | | | | |
|---|---|---|---|---|
| 6,447,090 | B1 * | 9/2002 | Saruta | 347/19 |
| 6,494,559 | B1 * | 12/2002 | Tsuji | 347/19 |
| 6,554,411 | B1 | 4/2003 | Hatasa et al. | 347/86 |
| 6,565,198 | B2 * | 5/2003 | Saruta et al. | 347/86 |
| 6,609,788 | B2 | 8/2003 | Hatasa et al. | 347/86 |
| 6,616,255 | B2 * | 9/2003 | Murakami et al. | 347/7 |
| 6,619,776 | B2 * | 9/2003 | Yoshiyama et al. | 347/7 |
| 6,631,967 | B1 | 10/2003 | Saruta | 347/19 |
| 6,631,978 | B1 | 10/2003 | Watanabe et al. | 347/49 |
| 6,742,857 | B2 | 6/2004 | Koshikawa et al. | 347/19 |
| 6,742,872 | B2 | 6/2004 | Fukazawa et al. | 347/50 |
| 6,824,258 | B2 | 11/2004 | Yamamoto et al. | 347/86 |
| 6,862,652 | B1 | 3/2005 | Tsuji | 711/103 |
| 6,893,118 | B2 * | 5/2005 | Murakami et al. | 347/84 |
| 6,916,076 | B2 * | 7/2005 | Yoshiyama et al. | 347/7 |
| 6,935,716 | B2 | 8/2005 | Hatasa et al. | 347/19 |
| 6,955,411 | B2 * | 10/2005 | Saruta | 347/19 |
| 6,962,079 | B2 | 11/2005 | Eguchi et al. | 73/304 R |
| 6,969,140 | B2 * | 11/2005 | Saruta | 347/19 |
| 7,033,011 | B2 * | 4/2006 | Murakami et al. | 347/86 |
| 7,093,927 | B2 * | 8/2006 | Tsuji | 347/50 |
| 7,118,204 | B2 | 10/2006 | Hatasa et al. | 347/86 |
| 7,125,109 | B2 | 10/2006 | Watanabe et al. | 347/86 |
| 7,128,380 | B2 | 10/2006 | Hatasa et al. | 347/7 |
| 7,131,327 | B2 | 11/2006 | Eguchi et al. | 73/304 |
| 7,267,415 | B2 * | 9/2007 | Saruta | 347/7 |
| 2002/0109761 | A1 | 8/2002 | Shimizu et al. | 347/86 |
| 2003/0197751 | A1 * | 10/2003 | Saruta | 347/19 |
| 2005/0151811 | A1 | 7/2005 | Shimizu et al. | 347/86 |
| 2005/0179750 | A1 | 8/2005 | Hayasaki et al. | 347/86 |
| 2005/0185034 | A1 | 8/2005 | Anma et al. | 347/86 |
| 2005/0219303 | A1 | 10/2005 | Matsumoto et al. | 347/19 |
| 2006/0139422 | A1 | 6/2006 | Hatasa et al. | 347/86 |
| 2006/0146107 | A1 | 7/2006 | Tsurui et al. | 347/86 |
| 2006/0244795 | A1 | 11/2006 | Hayasaki et al. | 347/86 |
| 2006/0290722 | A1 | 12/2006 | Kitagawa et al. | 347/7 |

FOREIGN PATENT DOCUMENTS

| | | |
|---|---|---|
| CN | 1151026 C | 5/2004 |
| JP | 4-275156 | 9/1992 |
| JP | 6-155769 | 6/1994 |
| JP | 7-76104 | 3/1995 |
| JP | 2000-301738 | 10/2000 |
| JP | 2001-96869 | 4/2001 |

* cited by examiner

LIQUID CONTAINER, LIQUID SUPPLY SYSTEM AND PRINTING DEVICE USING LIQUID CONTAINER, AND CIRCUIT BOARD FOR LIQUID CONTAINER

BACKGROUND OF THE INVENTION

1. Field of the Invention

The present invention relates to a liquid container. More specifically, the present invention relates to a liquid container used in a configuration to detect information on a state of the liquid container (such as information on residual quantity in an ink tank used for ink jet printing), by use of light emitting means such as a light emitting diode (LED). The present invention also relates to a liquid container system and a printing apparatus using the liquid container, and to a circuit board for the liquid container.

2. Description of the Related Art

Performances of ink jet heads are dramatically improved in recent years along with increasing demands for higher resolution and higher image quality printing. Specifically, printing speed and printing throughput are improved by increasing the number of ejection ports and energy generating elements in a printing head or by increasing the number of energy generating elements to be operated simultaneously.

In order to learn the lifetime or appropriate time for replacing such a high-performance printing head, Japanese Patent Application Laid-open No. 7-76104 (1995) discloses a configuration in which an ink jet head 1105 includes a memory element such as an electrically erasable programmable read-only memory (EEPROM) for storing specific information on the ink jet head 1105.

FIG. 28 is an explanatory view of this configuration. In the configuration of the drawing, electric signal lines from the printing head 1105 provided with an EEPROM 1108 essentially consist of lines 1106(*a*) to 1106(*c*). These lines are extended from connectors 1028 on the printing head 1105 to flexible cables 1206, and are connected to a central processing unit (CPU) 1300 of a control circuit portion of a printing apparatus body.

Further, there is also a technique configured to embed a memory element for storing information on residual quantity and the like on each ink cartridge so as to display the information on a printing apparatus body's side.

FIGS. 29 and 30 are explanatory views showing examples of the above-described two configurations. In the configuration shown in FIG. 29, a plurality of ink cartridges, which correspond to inks of four colors, 1001K, 1001Y, 1001M, and 1001C embed memory elements 1100A, 1100B, 1100C, and 110D, respectively. Signal lines for these memory elements are bundled on the printing head 1105 together with signal lines for the memory element 1018. The group of the signal lines 1016 is extended from the connectors 1028 on the printing head 1105 to the flexible cables 1206, and is connected to the CPU 1300 of the control circuit portion of the printing apparatus body. Meanwhile, in the configuration shown in FIG. 30, the memory elements 1100A to 1000D capable of storing various pieces of information are directly connected to the CPU 1300 of the control circuit portion of the printing apparatus body without passing through the printing head 1105. In this way, the CPU 1300 can perform suitable operation control based on the direct connection.

As described above, there are various configurations in terms of electric connection between the memory elements, which are arranged on the printing head and on the ink cartridges, and the printing apparatus body in conformity with the structure of the printing apparatus.

The ink has been also improved in recent years to achieve the above-described high-definition printing. Specifically, the ink including components with extremely complicated and delicate composition ratios in consideration of various characteristics is used for achieving a high printing performance. Moreover, the improved ink has been used. For example, such the improved ink may contain pigment components instead of dyestuff components in order to enhance weather resistance of the ink or fastness of a printed image. Meanwhile, a resin component may be added to the ink for promoting fastness to achieve higher speed. Moreover, the ink may include a composition blended on the assumption that ink components for respective colors are subjected to chemical reactions in the case of multicolor printing. In addition, the type of the ink may be changed in response to the quality of a printing material (such as dedicated paper for ink jet printing, plain paper, a resin sheet or a cloth) or in response to an intended visual effect (presence or absence of gloss, the use of gold and silver colors, and the like).

As described above, the improvement in higher printing quality is attempted by use of the ink having the components or the composition ratios different from those of conventional ink. When only the same type of the improved ink is used in a printing apparatus, the printing apparatus can operate without any problem and perform high-definition printing while exploiting the performance of the ink. On the contrary, in the case of using different types of the ink alternately in the single printing apparatus, the following obstacle may arise when the printing apparatus is particularly configured to allow attachment of a plurality of ink cartridges to a single ink jet head including a plurality of ejection portions. Specifically, the different types of ink are mixed together inside the single ejection portion, and lead to aggregation or solidification attributable to a reaction between the ink components and eventually to deposition of the ink onto an ink supply path inside the ejection portion, a fluid path inside an ejection opening or a surface (an ejection surface) of the printing head where the ejection openings are formed. When such an obstacle arises, a printing operation will be hindered. Accordingly, it is necessary to make an arrangement to avoid mixture of the different types of the ink inside the printing apparatus. In this context, it is strongly recommended to configure the printing apparatus not to connect an ejection portion that corresponds to a certain type of ink to an ink cartridge that contains a different type of ink.

A first method of solving such an obstacle is to use an ink cartridge in a different shape depending on the type of the ink and to eliminate compatibility between ink cartridges configured to contain different types of the ink. In this case, however, the ink cartridges have disadvantages of a tremendous increase in manufacturing costs and complication to store and manage the ink cartridges having the different shapes.

On the contrary, the configuration provided with the memory elements 1100A to 1100D for storing data representing the types of the ink contained in the respective ink cartridges 1001K to 1001C as shown in FIG. 29 or FIG. 30 is effective as a second method. For example, Japanese Patent Application Laid-open No. 6-155769 (1994) discloses a configuration in which a memory element of an ink cartridge is connected to an electric circuit of a printing apparatus body so that the type of the ink can be identified by use of a difference in a voltage value. Meanwhile, Japanese Patent Application Laid-open No. 2000-301738 discloses a configuration in which a control IC of a printing apparatus body is connected to a memory element which stores data indicating the type of ink contained therein, manufacturing date, and the like. The control IC then reads and writes the data. Here, it is possible to prevent occurrence of the above-described obstacle by detecting connection of an ink cartridge containing a certain type of ink to an ejection portion corresponding to a different type of ink based on the information on the ink cartridge's side and informing a user of an event of improper connection.

As described above, Japanese Patent Application Laid-open Nos. 6-155769 (1994) and 2000-301738 disclose the configurations in which ink cartridges 1001K to 1001C respectively store the information on the types of the ink contained therein, residual quantity thereof, expiration dates, and the like. Meanwhile, Japanese Patent Application Laid-open No. 7-076104 (1995) discloses a configuration in which information on an identification number of the printing head 1105, the total number of prints, and the like is stored in the memory element 1018 embedded in the printing head 1105. By a combination of these configurations, the CPU 1300 of the printing apparatus body can identify the ink cartridges 1001K to 1001C and the types of the ink contained therein by reading the information respectively out of the memory element 1018 and 1100A to 1100D. In addition, the CPU 1300 can determine lifetime and replacement timing of the printing head 1105 and of the ink cartridges 1001A to 1001D appropriately. Moreover, it is also possible to execute fine printing by setting optimal printing conditions corresponding to the ink and conditions for a recovery process for optimizing an ink ejection performance of the printing head.

In addition, Japanese Patent Application Laid-open No.4-275156 (1992) discloses another configuration for appropriately informing the lifetime and replacement timing of the printing head 1105 and of the ink cartridges 1001A to 1001D appropriately. Specifically, in this configuration, a cartridge formed by integrating a printing head and an ink tank includes a light emitting portion in the form of a light emitting diode (LED). Here, it is possible to inform ink residual quantity in response to information from a memory element storing the number of power distribution to the cartridge for printing.

When using the configuration disclosed in Japanese Patent Application Laid-open No. 4-275156 (1992), it is desirable to continue display until immediately before a user replaces the ink tank so that the user can execute the operation to replace the ink tank without causing an error. When the ink cartridge subject to replacement is displayed by means of light emission, such display will largely contribute to an easier replacing operation by the user. In this case, the user is supposed to detach the ink cartridge including the LED emitting the light.

Here, Japanese Patent Application Laid-open No. 4-275156(1992) only discloses the state where ink tank provided with an indicator is attached to a printer body. However, when considering that the ink tank is rendered detachable from the printer body, it is conceivable that this configuration is assumed to adopt a configuration of connection similar to those disclosed in Japanese Patent Application Laid-open No. 7-076104 (1995) and 2000-301728, and that power is supplied from the printer's side to the indicator and the memory in the attached state.

Therefore, replacement in the displayed state is equivalent to detachment in the state of connecting a power source and a communication line, which is so-called hot-swap. The memory is usually a semiconductor element which is manufactured by use of delicate processes and is operated based on a well-managed power source. For this reason, if the ink tank is detached from the printing apparatus body during access to the memory and the communication line is suddenly shut down, there is a risk of destruction of not only the information stored in the memory but also the memory in itself depending on the type or the processes of the memory element.

Here, a case of performing information in conformity with the ink residual quantity of each of the cartridges by use of the light emitting element disclosed in Japanese Patent Application Laid-open No. 4-275156 (1992) is considered. The ink residual quantity can be detected for instance by causing a main control portion of the printing apparatus to count the number of dot printing in the course of printing control and to subtract the counted value from a numerical value corresponding to an initial content of the ink. In this case, the main control portion judges loq ink residual quantity and informs that fact to the user when the calculated value becomes equal to or below a predetermined proportion relative to the initial content of the ink. At the same time, this information is written in the memory. The process performed at this time is to transmit commands corresponding to the ink residual quantity to a circuit board on the ink cartridge inclusive of the memory, the LED, and the like. These commands include a command to update the ink residual quantity by reading and writing the memory (memory access), a command to start display by driving the LED in conformity with the information, and the like.

In this configuration, when the number of the ink cartridges is increased, more memory access commands and drive control commands for the LEDs will be transmitted on the lines. As a consequence, when the residual quantity varies among the ink cartridges, those commands will be transmitted frequently. In this way, along with the increase in the opportunities of memory access, there is a growing possibility of destruction of the contents stored in the memories due to the characteristic of power shutdown sequences caused by the hot-swap.

In particular, the memory stores a variety of important information besides the ink residual quantity, namely, information on the color of the ink contained therein, manufacturing information on the ink cartridge such as a specific number or a manufacturing lot number, and the like. In this regard, the memory is typically formed of a non-volatile memory element so that the memory can retain the stored contents even when the power is not supplied thereto (in the state where the ink cartridge is not attached to the printing apparatus). Therefore, if the stored contents are destroyed and it is not possible to make reference to the important information such as the information on the ink residual quantity which is constantly updated, the function of the printing apparatus to detect the ink residual quantity will not be operated normally. As a consequence, the ink may run out in the course of printing, and the printing apparatus may fail to offer high-quality prints as requested by the user.

Accordingly, it is conceivable to shut down the power safely at the time of an operation by the user to take place before the ink replacing operation, such as an operation by the user for opening a cover or the like provided on the printer body. However, the indicator will be also turned off in this case, and it will be uncertain as to which ink tank is subject to replacement. As a result, the advantage of the configuration to provide the indicator will be lost.

In addition, another problem of the conventional technique derives from the configuration of the connectors.

For example, the following problem arises when the memory elements for storing the variety of information including the ink type are mounted on the ink cartridges in addition to mounting the memory element 1018 on the printing head 1105. Specifically, in this case, it is necessary to electrically connect all the memory elements to the CPU 1300 of the control circuit portion of the printing apparatus body.

Therefore, when the number of the memory elements is increased, the number of the signal lines 1016 required for connecting the memory elements is also increased.

Particularly, it is conceivable that even a low-price printing apparatus applies various types of ink in recent years. For this reason, connectors for connecting the memory elements respectively provided on the printing head and on the plurality of ink cartridges to the CPU 1300 of the control circuit portion of the printing apparatus body are equipped. Typical color printing applies ink in four colors (black, yellow, magenta, and cyan). Accordingly, four ink cartridges 1001K, 1001Y, 100M, and 1001C respectively containing the respective colors of ink are simultaneously attached to the printing apparatus body. Therefore, the four memory elements 1100A to 1100D provided on the respective ink cartridges 1001K, 1001Y, 100M, and 1000C require the signal lines 1016. Usually, each memory element is provided with two or more signal lines 1016. Meanwhile, when the printing head 1105 is also provided with the memory element 1018, it is necessary to provide three signal lines 1016, for example, in addition to the signal lines 1016 connected to the memory elements on the respective ink cartridges.

As a result, when connecting all the signal lines to the CPU 1300 through the printing head 1105 as shown in FIG. 29, it is necessary to provide the signal lines 1106 at least twice as many as the total number of the memory elements. The requirements also apply to the case shown in FIG. 30 where the memory element 1018 of the printing head 1105 and the memory elements 1100A to 1000D of the respective ink cartridges 1001K, 1001Y, 1001M, and 1001C are directly connected to the CPU 1300.

In addition, in the case of the configuration as disclosed in Japanese Patent Application Laid-open No. 4-275156 (1992) where each of the ink cartridges includes informing means and the ink residual quantity is informed by use the informing means, it is also necessary to provide a line to turn the informing means on and off. Here, each ink cartridge requires at least one line without considering a ground line. In other words, four or more signal lines are required in the case of using four or more ink cartridges to perform color printing. In this way, the number of connection to the printing apparatus will be further increased.

SUMMARY OF THE INVENTION

The present invention has been made to solve the foregoing problems. The present invention is applicable to an ink tank which is configured to provide the ink tank in the form of a cartridge detachable to a printer with a non-volatile memory element and informing means such as a light emitting portion, and is capable of transmitting information stored in the memory element to a printing apparatus body. The present invention is also applicable to the ink tank which is capable of performing processing in response to a state of each ink tank (such as ink residual quantity) by means of the transmission and informing the state by use of the light emitting portion. Now, an object of the present invention is to provide the ink tank which allows the light emitting portion to emit light until immediately before detachment without causing an obstacle such as destruction of contents in the non-volatile memory element or the non-volatile memory element in itself, and thereby to contribute to operation efficiency of a user.

Another object of the present invention is to achieve high-reliability and high-quality printing for a long time period by preventing destruction of the contents in the non-volatile memory element and the non-volatile memory element in itself attributable to hot-swap and reducing the number of memory access.

Still another object of the present invention is to suppress an increase in the number of signal lines to be connected to the printing apparatus body's side when using a plurality of ink tanks.

Still another object of the present invention is to clearly indicate the state of the ink tank immediately after replacement.

Yet another object of the present invention is to provide the non-volatile memory element with recoverability of the stored contents even if the contents disappear.

In a first aspect of the present invention, there is provided a liquid container detachably mounted on a printing apparatus, the printing apparatus capable of mounting at least of one liquid container and including a device side contact electrically connectable to a contact formed on the liquid container and an electric circuit having wiring for achieving common electrical connection between the respective contacts on the mounted liquid containers and the device side contacts, the liquid container comprising:

the contact electrically connectable to the device side contact;

a non-volatile information retention portion capable of retaining information on the liquid container;

a volatile information retention portion capable of retaining at least part of the information;

an informing portion;

a drive portion for driving the informing portion; and a control portion capable of controlling any of access to the non-volatile information retention portion, access to the volatile information retention portion, and drive of the informing portion by use of the drive portion to inform a condition of the liquid container, upon receipt of a command including individual information from the printing apparatus.

In a second aspect of the present invention, there is provided a circuit board provided on a liquid container detachably mounted on a printing apparatus, the printing apparatus capable of mounting at least of one liquid container and including a device side contact electrically connectable to a contact formed on the liquid container and an electric circuit having wiring for achieving common electrical connection between the respective contacts on the mounted liquid containers and the device side contacts, the circuit board comprising:

the contact electrically connectable to the device side contact;

a non-volatile information retention portion capable of retaining information on the liquid container;

a volatile information retention portion capable of retaining at least part of the information;

a drive portion for driving an informing portion; and a control portion capable of controlling any of access to the non-volatile information retention portion, access to the volatile information retention portion, and drive of the informing portion by use of the drive portion to inform a condition of the liquid container, upon receipt of a command including individual information from the printing apparatus.

In a third aspect of the present invention, there is provided a liquid supply system comprising:

a printing apparatus capable of mounting at least of one liquid container and including a device side contact electrically connectable to a contact formed on the liquid container and an electric circuit having wiring for achieving common electrical connection between the respective contacts on the mounted liquid containers and the device side contacts; and an ink container detachably mounted on a carriage of the printing apparatus, the ink container having:

the contact electrically connectable to the device side contact;

a non-volatile information retention portion capable of retaining information on the liquid container;

a volatile information retention portion capable of retaining at least part of the information;

an informing portion;

a drive portion for driving the informing portion; and a control portion capable of controlling any of access to the non-volatile information retention portion, access to the volatile information retention portion, and drive of the informing portion by use of the drive portion to inform a condition of the liquid container, upon receipt of a command including individual information from the printing apparatus.

In the first aspect of the present invention, the information may include condition information for indicating the condition of the liquid container, and at least the condition information may be retained by the volatile information retention portion.

Further, the control portion may have a mode for controlling the drive of the informing portion based on the condition information retained in the volatile information retention portion without accessing the non-volatile information retention portion. In relation to this, in a fourth aspect of the present invention, there is provided a printing apparatus comprising:

means for transmitting a command including a code for setting up the mode;

means for transmitting a command including a code for instructing to access to the volatile information retention portion after the transmission; and means for transmitting a command including a code for controlling drive of the informing portion based on the conditional information acquired from the volatile information retention portion in response to the access.

The control portion may perform at least any of acquiring and updating the condition information by receiving a command inputted from the printing apparatus for accessing the non-volatile information retention portion or the volatile information retention portion. In relation to this, in a fifth aspect of the present invention, there is provide a printing apparatus comprising means for transmitting a command including a code for accessing the non-volatile information retention portion or the volatile information retention portion.

The non-volatile information retention portion may have a first and a second information retention portions.

Here, the condition information retained by the first retention portion may be transferred to the volatile information retention portion in response to input of a code for allowing the printing apparatus to acquire the condition information when there is power supply to the liquid container, and the drive of the informing portion may be controlled based on the condition information retained by the volatile information retention portion upon subsequent input of the code. In relation to this, in a sixth aspect of the present invention, there is provide a printing apparatus comprising means for transmitting a command including a code for acquiring the conditional information.

The information may be retained respectively in the first and second information retention portions, the information may be compared with each other at a predetermined timing, and the information in the first information retention portion may be rewritten based on the information retained in the second information retention portion when the information are different from each other. In relation to this, in a seventh aspect of the present invention, there is provided a printing apparatus comprising:

means for accessing to the first and second information retention portions at a predetermined timing and comparing the information retained therein with each other; and means for causing the rewrite of the information in the first information retention portion based on the information retained in the second information retention portion when the information are different from each other.

According to the present invention, it is possible to execute control commands for turning on and off the light emitting portion, for example, as informing means while accessing a volatile information retention portion without using a non-volatile information retention portion (the memory element) in the state where hot-swap is likely to take place. In this way, it is possible to perform clear indication to a user by blinking the light emitting portion of the ink tank subject to replacement, and meanwhile to prevent destruction of the contents stored in the non-volatile information retention portion in itself attributable to the hot-swap. Moreover, it is possible to protect the information stored in the memory element and the memory element in itself by stopping a clock for the memory element and thereby prohibiting access thereto. In addition, it is possible to reduce the number of access to the non-volatile information retention portion, and thereby to extend the lifetime of the portion so as to perform high-reliability and high-quality printing for a long time period.

Further, the present invention is configured to control access to the memory element (the information retention portion) and control the informing means in response to reception of a command from the printing apparatus containing individual information for specifying the ink tank. In this way, it is possible to suppress an increase in the number of the signal lines to be connected to the printing apparatus body's side when using a plurality of ink tanks, and to ensure flexible response even when the number of ink tanks is increased.

Moreover, according to a printing apparatus and a liquid container according to the present invention, it is possible to clearly indicate the state of the ink tank immediately after attachment.

Furthermore, according to the printing apparatus and a liquid container according to the present invention, it is possible to recover the contents stored in part of the non-volatile information retention portion even if the contents disappear.

The above and other objects, effects, features and advantages of the present invention will become more apparent from the following description of embodiments thereof taken in conjunction with the accompanying drawings.

BRIEF DESCRIPTION OF THE DRAWINGS

FIG. 21A is a view showing a state of the control for attaching the ink tank where all the ink tanks are attached properly and respective LEDs are turned on, and FIG. 21B is a view for explaining a carriage moving to a position for an optical check when the body cover is closed after the LEDs are turned on;

DETAILED DESCRIPTION OF PREFERRED EMBODIMENTS

Now, embodiments of the present inventions will be described in detail with reference to the accompanying drawings.

1. Examples of Mechanical Structures to Which the Present Invention is Applicable First, examples of mechanical structures of a cartridge to which the present invention is applicable and of an ink-jet printing apparatus using the cartridge will be described below.

1.1 Ink Tank (FIGS. 1A to 5B)

Figure 1A:
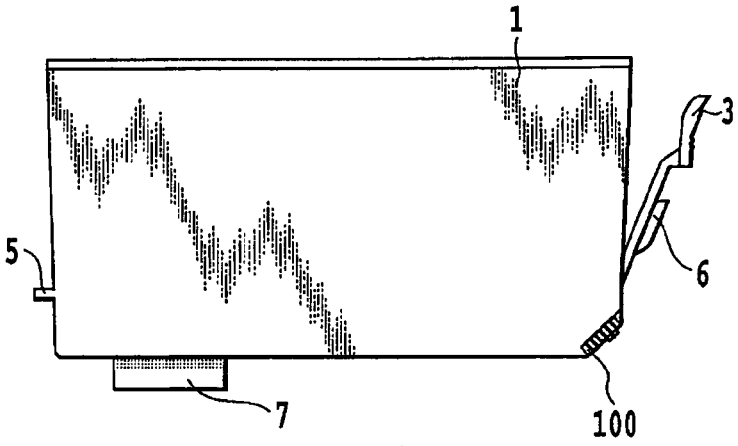
FIGS. 1A, 1B, and 1C are respectively a side view, a front view, and a bottom view of an ink tank applicable to which the present invention is applicable.
Figure 1B:
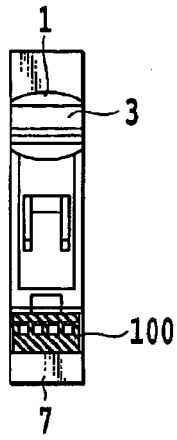
Figure 1C:
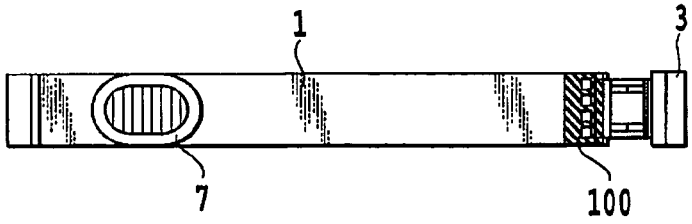
Figure 2:
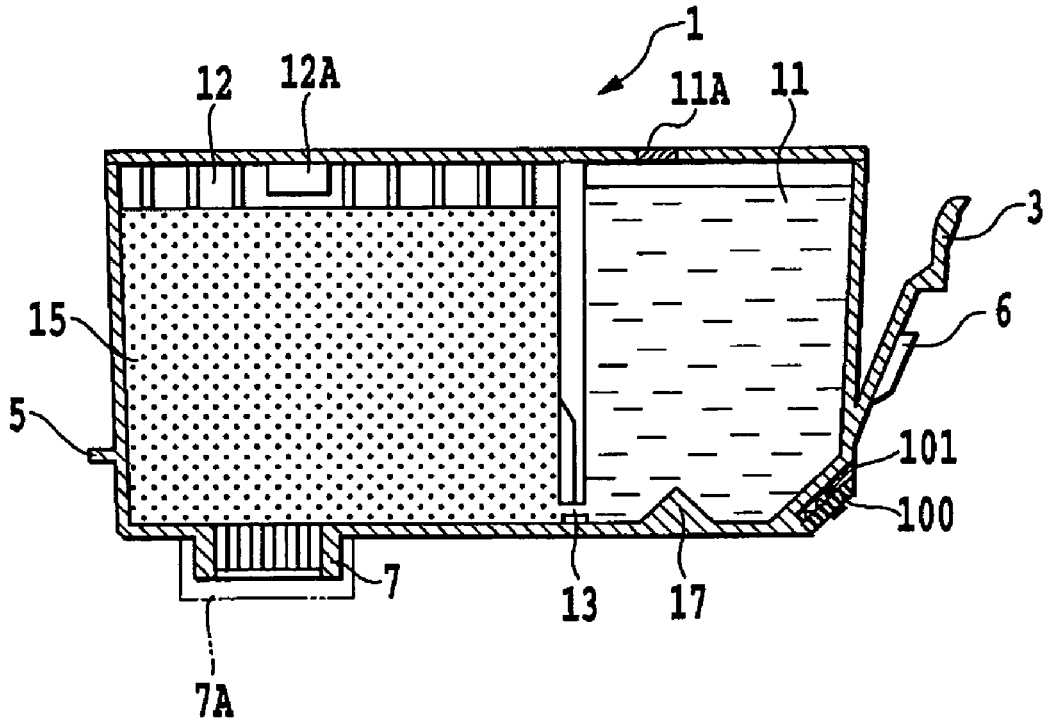
FIG. 2 is a sectional side view of the ink tank a to which the present invention is applicable.

FIGS. 1A, 1B, and 1C are respectively a side view, a front view, and a bottom view of an ink tank applicable to a liquid container according to an embodiment of the present invention. Meanwhile, FIG. 2 is a sectional side view of the ink tank. In the present invention, a front face of the ink tank means a face opposed to a user for allowing the user to perform operations (such as an attaching operation) and providing information (emission of LEDs to be described later) to the user.

As shown in FIGS. 1A to 1C, an ink tank 1 of this embodiment includes a supporting member 3 which is supported on a lower part on the front face side. The supporting member 3 is formed integrally with an outer package of the ink tank 1 by use of resin, and is rendered displaceable pivotally around a supported portion when performing an attaching operation to a tank holder and the like to be described later. A first engaging part 5 and a second engaging part 6 (which is integrated with the supporting member 3 in this example) to be engaged with locking parts on the tank holder's side are formed respectively on a back face side and the front face side of the ink tank 1. Attachment of the ink tank 1 to the tank holder is ensured by engagement between the engaging parts and the locking parts. The operation of attachment will be described later with reference to FIGS. 7A to 7C.

An ink supply port 7 to be connected to an ink inlet port on a printing head to be described later at the time of attachment to the tank holder is formed on a bottom face of the ink tank 1. A base body constituting a principal part of this embodiment is mounted at a junction of the bottom face and the front face, underneath the supported portion of the supporting member 3. Although the base body may be formed into a chip shape or a plate shape, the base body will be hereinafter described as a board 100.

FIG. 2 is the sectional side view of the ink tank 1. The interior of the ink tank 1 is divided into an ink chamber 11 located on the front face side where the supporting member 3 and the board 100 are provided and a negative pressure generating material chamber 12 located on the back face side and communicating with the ink supply port 7. The both chambers are connected to each other through a communicating port 13. Ink is directly stored in the ink chamber 11. Meanwhile, the negative pressure generating material chamber 12 is provided with an ink absorber made of sponge or fiber assembly configured to retain the ink by means of impregnation. Hereinafter the absorber will be referred to as a porous member 15 for convenience sake. This porous member 15 is configured to sufficiently prevent ink leakage from an ink ejection portion while balancing with retention of a meniscus to be formed on an ink ejection nozzle of the printing head, and to generate appropriate negative pressure set in an allowable range for the printing head to perform an ink ejecting operation.

On an upper face of the negative pressure generating material chamber 12, formed is an air communicating portion 12A configured to introduce outside air for relaxing the negative pressure increased with the ink supply to the printing head and thereby maintaining the negative pressure in a predetermined desirable range.

Meanwhile, the ink tank 1 shown in FIG. 2 can be manufactured by preparing a body of the ink tank 1 provided with the board to be described later, and then injecting the ink into the body. An ink inlet port for carrying out this method can be formed on an upper face of the ink chamber 11, for example. Then, this inlet port can be sealed with a sealing member 11A after injecting the ink.

As the ink tank 1 is used and the ink is consumed, the inlet port can be formed again by detaching or destroying the sealing member 11A after the contained ink is virtually exhausted. Thereafter, it is possible to inject the ink with a syringe or the like and to seal the inlet port by use of the sealing member 11A or a substitute member as appropriate. Alternatively, it is possible for instance to form an aperture in a different region on the upper face of the ink chamber 11 instead of using the inlet port originally formed thereon, and to seal the aperture as appropriate after injecting the ink therethrough.

In addition, it is possible to attach a sealing member 7A to the ink supply port 7 for preventing ink leakage in the course of transport and storage of the manufactured ink tank 1. This sealing member 7A may be formed into any form such as a cap or a tape member as long as the sealing member 7A is configured to exert a given sealing performance and is rendered detachable before mounting the ink tank to the printing head. Alternatively, the ink supply port 7 can be sealed with the sealing member 7A or a substitute member after the ink tank is detached from the printing head after starting the use.

Note that the interior structure of the ink tank 1 is not limited to the above-described aspect of division into the chamber for the porous member and the chamber for directly storing the ink. For example, it is also possible to fill the porous member substantially in the entire inner space of the ink tank. Alternatively, instead of using the porous member as the negative pressure generator, it is possible to fill the ink into a bag-shaped member made of an elastic material such as rubber, which is designed to generate tension in the direction of increasing a volume, and to apply negative pressure to the ink inside by means of the tension generated by this bag-shaped member. In addition, it is also possible to define at least part of the space for containing the ink by use of a flexible material, to fill only the ink in that space, and to generate negative pressure by applying a spring force to the flexible material. In these cases, it is also possible to manufacture the ink tank by injecting the ink as similar to the previously described example. Moreover, in these cases, an air communicating poet may be provided in order to introduce outside air into an ink containing space for relaxing the negative pressure increased with the ink supply to the printing head and thereby maintaining the negative pressure in a predetermined desirable range. In such a case, it is possible to inject the ink by use of the air communicating port.

A detection target 17 is formed at a bottom of the ink chamber 11 in an appropriate region so that the detection target can face an ink residual quantity detection sensor (to be described later) provided on the printer when attaching the ink tank 1 to the printer. In this embodiment, the ink residual quantity detection sensor is an optical sensor utilizing a light emitting portion and a light receiving portion. Meanwhile, the detection target 17 is made of a transparent or translucent material and is formed into a prism shape having inclined faces with predetermined shape, angle, and the like so as to reflect light from the light emitting portion back to the light receiving portion (to be described later) appropriately when the ink is not contained.

Figure 3A:
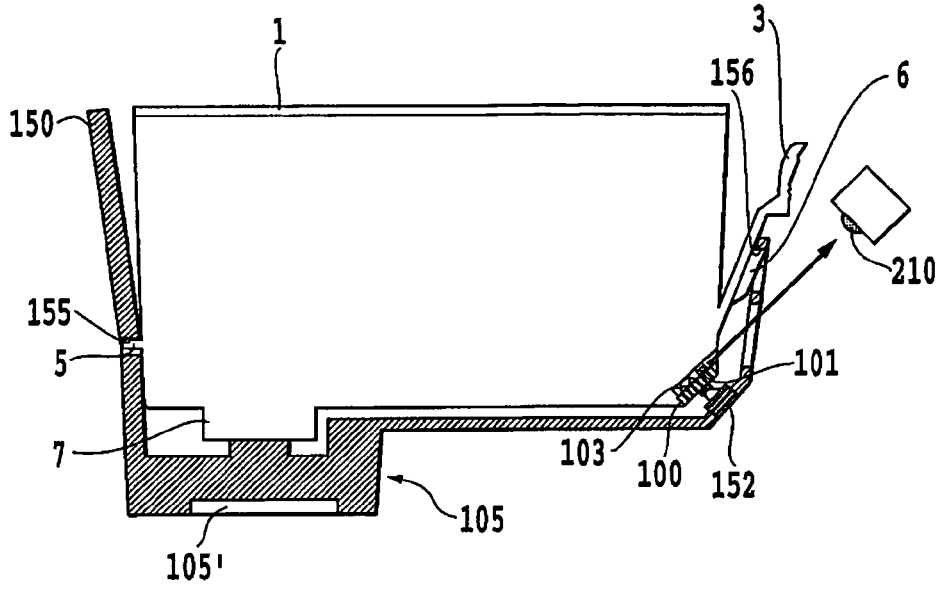
FIGS. 3A and 3B are schematic side views for explaining an outline of functions of a board to be attached to the ink tank to which the present invention is applicable.
Figure 3B:
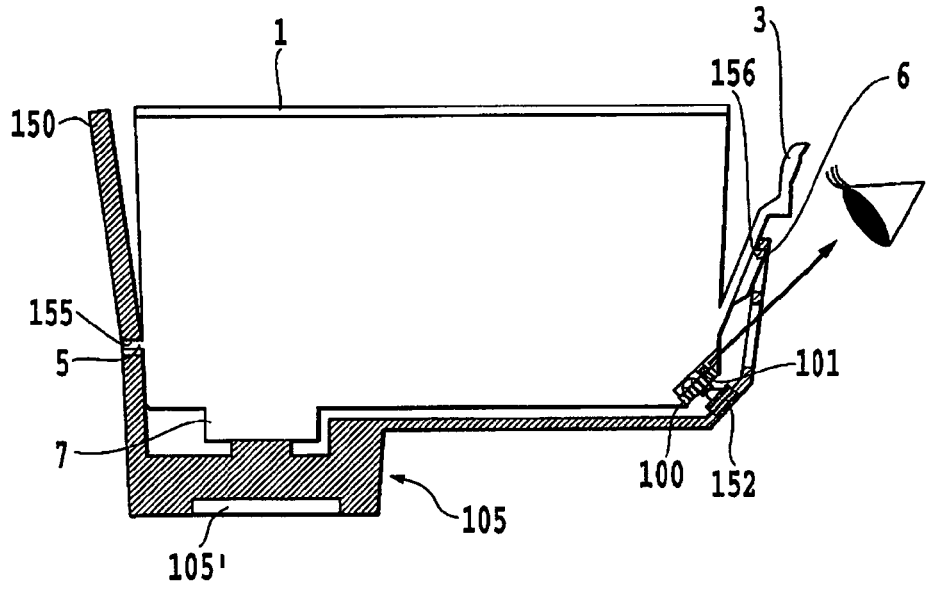
Figure 4A:
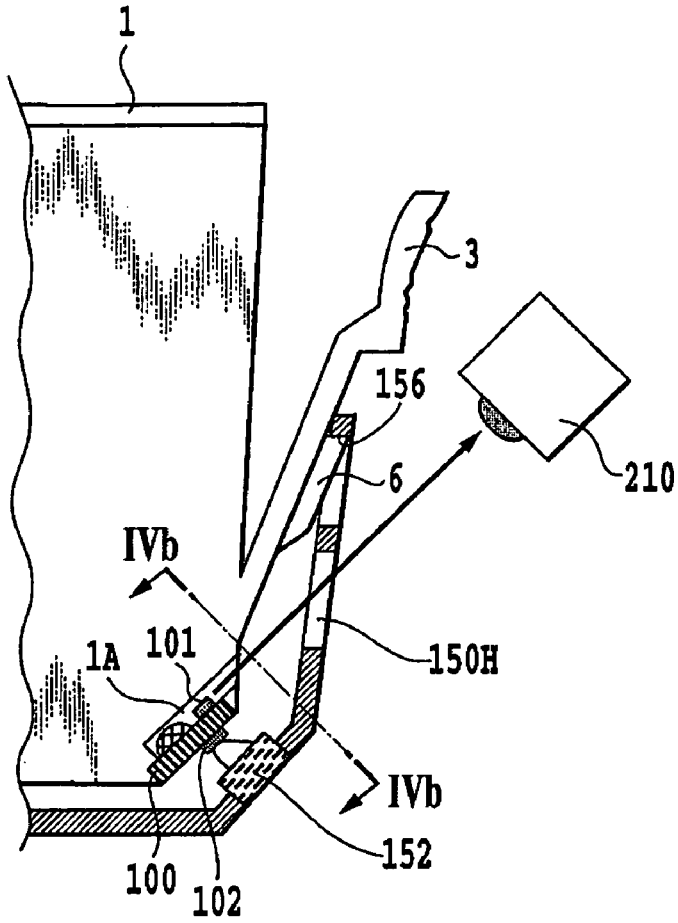
FIGS. 4A and 4B are respectively an enlarged view of a principal part shown in FIGS. 3A and 3B, and a cross-sectional view taken along the IVb direction therein.
Figure 4B:
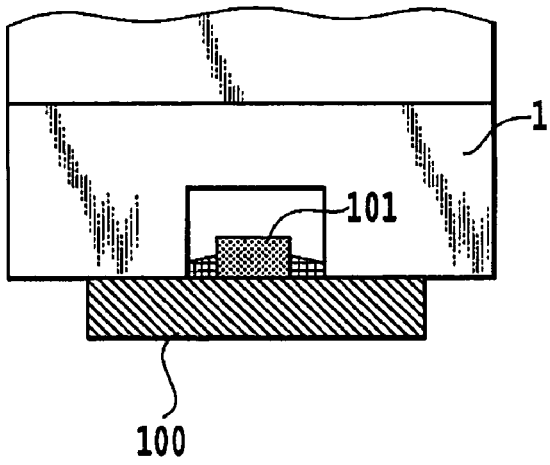
Figure 5A:
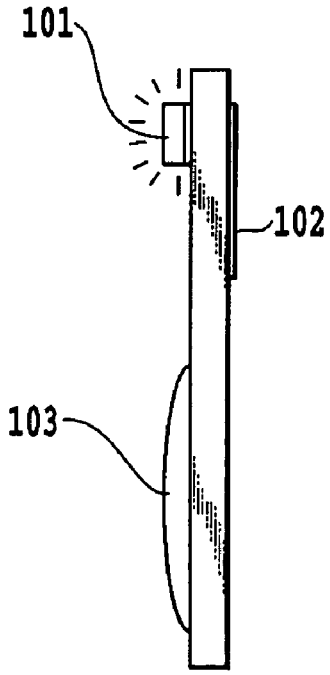
FIGS. 5A and 5B are respectively a side view and a front view showing an example of a control board to be attached to the ink tank to which the present invention is applicable.
Figure 5B:
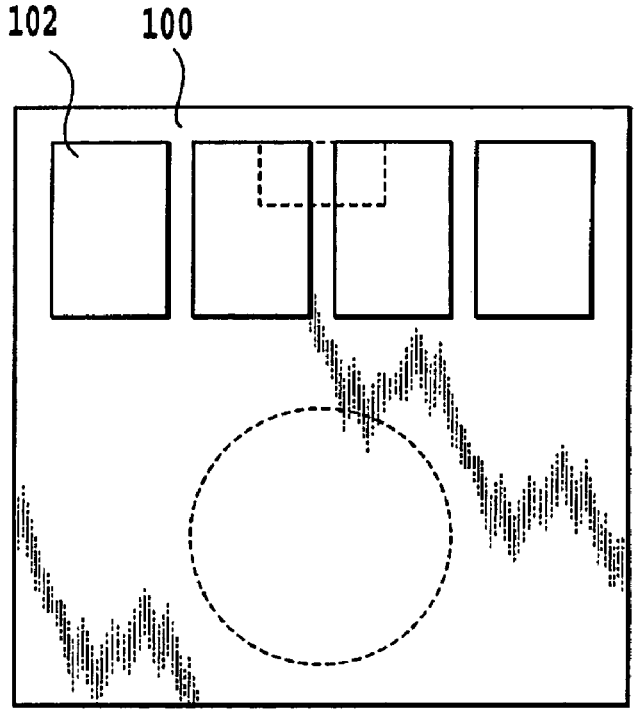

The configuration and functions of the board 100 constituting the principal part of this embodiment will be now described with reference to FIGS. 3A to 5B. Here, FIGS. 3A and 3B are schematic side views for explaining an outline of functions of the board to be attached to the ink tank applicable to the first embodiment of the present invention. FIGS. 4A and 4B are respectively an enlarged view of a principal part shown in FIGS. 3A and 3B, and a cross-sectional view taken along the IVb direction therein. FIGS. 5A and 5B are respectively a side view and a front view showing an example of the control board 100 to be attached to the ink tank according to the first embodiment.

The first engaging part 5 and the second engaging part 6 of the ink tank 1 are rendered engageable respectively with a first locking part 155 and a second locking part 156 on a holder 150 integrated with a printing head unit 105 that includes a printing head 105'. By engagement thereof, the ink tank 1 is attached and fixed to the holder 150. Moreover, at this time, a contact 152 provided on the holder 150 (such a contact will be hereinafter referred to as a connector) contacts an electrode pad 102 (see FIG. 5B) formed as a contact on a surface located outside the board 100 provided on the ink tank. In this way, electric connection is established.

A first light emitting portion 101 such as an LED configured to emit visible light and a control portion 103 having functions such as controlling this light emitting portion are provided on a surface of the board 100 facing the inside of the ink tank 1. Moreover, the control portion 103 controls light emission by the first light emitting portion 101 by use of an electric signal to be supplied from the connector 152 via the pad 102. Here, FIG. 5A shows a state where the control portion 103 is mounted on the board 100 and then covered with a sealing agent for protection. When embedding a memory element for storing information such as a color of the ink contained in the ink tank or residual quantity of the ink, it is also possible to mount the memory element in the same position and to cover the memory element with a sealing agent.

Here, as described previously, the board 100 constituting the principal part of this embodiment is formed at the junction of the bottom face and the front face of the ink tank 1 and on the lower side of the supported portion of the supporting member 3. An inclined face is formed on the ink tank 1 for connecting the both faces. Therefore, when the first light emitting portion 101 emits light, part of the light is projected in the direction from the front face side of the ink tank 1 to the outside along the inclined face.

By using the board 100 having the above-described layout configuration, it is possible to indicate desired information on the ink tank 1 not only to a printing apparatus (and eventually to a host device such as a computer connected thereto) but also to a user directly while utilizing the first light emitting portion 101. Specifically, as shown in FIG. 3A, it is possible to dispose the light receiving portion in an appropriate position on an end of a scanning range of a carriage for mounting the holder 150 so as to receive the light projected to the upper right direction in the drawing, and thereby to control the light emission of the first light emitting portion 101 when the carriage is located in the end of a scanning range. In this way, the printing apparatus can recognize the desired information on the ink tank 1 by use of the contents of the light received by the light receiving portion. Meanwhile, when the light emission from the first light emitting portion 101 is controlled by positioning the carriage in the center of the scanning range, for example, a user can recognize the desired information on the ink tank 1 by visually checking the state of light emission.

The desired information on the ink tank (the liquid container) 1 for instance includes the following information, namely, appropriateness of the attachment condition of the ink tank 1 (i.e. as to whether or not the ink tank 1 is perfectly attached), appropriateness of the attached position (as to whether or not the ink tank is properly attached to a predetermined position on the holder in terms of the color of the ink contained therein), the ink residual quantity (as to whether there is a sufficient amount of the ink or not), and the like. The foregoing information can be indicated by way of light emission and the state of the light emission (such as blinking). The light emission control and relevant aspects of indicating the information will be described later along with explanation for a configuration of a control system.

A favorable example of a layout and operations of the board 100 and the first light emitting portion 101 is illustrated in FIGS. 4A and 4B. Specifically, it is preferable to form a space 1A at least along an optical axis (as indicated with an arrow) at a portion of the ink tank 1 opposed to the surface of the board 100 where the first light emitting portion 101 and the control portion 103 are provided. This is because the light emitted from the first light emitting portion 101 is supposed to reach the first light receiving portion 210 as a constituent of position detecting means for detecting an ink tank attachment position and to reach a view field of a user smoothly. For the same purpose, designing the layout position and the shape of the supporting member 3 appropriately prevents the optical axis from being blocked. Moreover, the holder 150 is provided with a hole (or a light transmissive portion) 150H for securing the optical axis.

Here, it is also possible to dispose the first light emitting portion 101 while defining an appropriate posture to increase intensity of the light traveling in the above-described direction. Alternatively, it is possible to improve directivity by placing a lens or the like on the optical path. Moreover, while the light emitting portion per se constitutes a display portion in this example, it is also possible to separate a display function. For example, it is possible to provide a portion for outputting the light either in a given region on the front face of the ink tank (such as the supporting member 3 or more particularly an operating portion 3M to allow a user operation) or in a given region on a front face of the tank holder 150 in order to fulfill the display function. Then, a member for guiding the light emitted from the LED or the like may be formed on the board, the ink tank or on the tank holder. Further, the location of the first light receiving portion 210 is not limited to the position shown in FIG. 3A or a position shown in FIG. 10 to be described later, and the first light receiving portion 210 may be formed in a different region. In this case, it is satisfactory if the light is projected and guided in the direction toward the first light receiving direction as well as the direction effective for the visual check by the user. In addition, it is also possible to guide the light emitted from the first light emitting portion 101 to a light receiving portion of an ink residual quantity detection sensor. In this case, the first light emitting portion 101 will serve as a light emitting portion of the ink residual quantity detection sensor as well.

Figure 6:
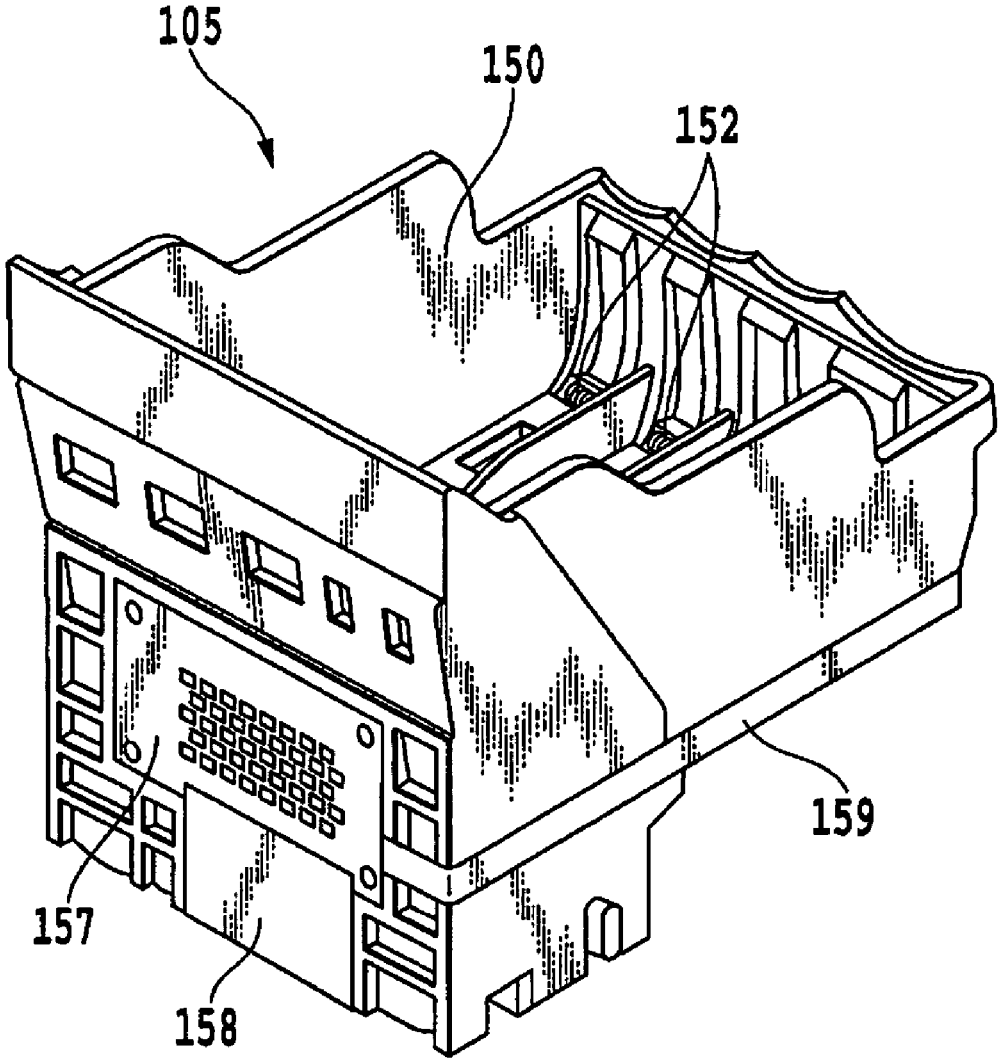
FIG. 6 is a perspective view showing an example of a printing head unit including a holder which allows attachment of the ink tanks to which the present invention is applicable.

1.2 Ink Tank Fixture (FIGS. 6 to 8)

Figure 7B:
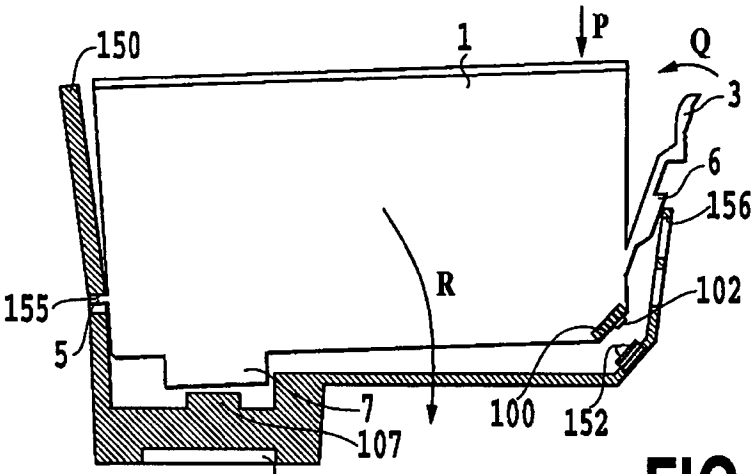
FIGS. 7A, 7B, and 7C are schematic side views for explaining an operation to attach the ink tank to which the present invention is applicable to the holder shown in FIG. 6.
Figure 7C:
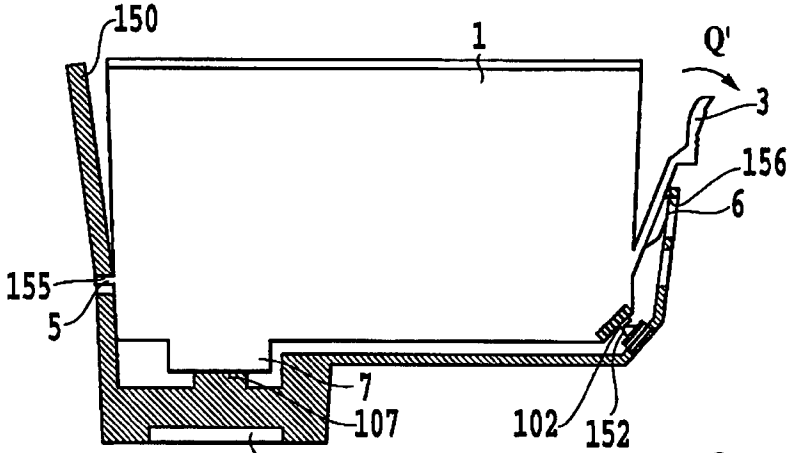
Figure 7A:
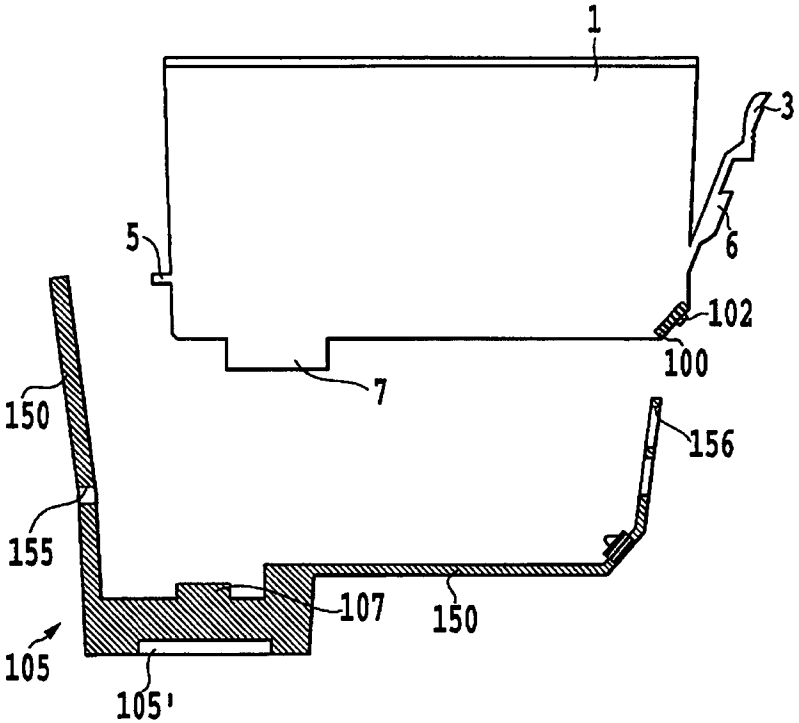

FIG. 6 is a perspective view showing an example of a printing head unit configured to realize attachment and detachment of the ink tanks according to the first embodiment. Meanwhile, FIGS. 7A, 7B, and 7C are views for explaining an operation to attach the ink tanks to the printing head unit.

The printing head unit 105 generally includes the holder 150 for detachably holding a plurality (4 pieces in the drawing) of ink tanks, and the printing head 105' (not shown in FIG. 6) to be disposed on a bottom face side. Here, an ink inlet port 107 on the printing head positioned at the bottom of the holder is connected to the ink supply port 7 on the ink tank by attaching each of the ink tanks to the holder 150. In this way, an ink communicating path is formed between the holder and the ink tank.

A component provided with an electrothermal transducer element in a fluid path constituting a nozzle can be used in the printing head 105'. This component is configured to apply thermal energy to the ink by supplying electric pulses constituting printing signals to the electrothermal transducer element, and to utilize pressure generated by a foaming (boiling) phenomenon of the ink attributable to a phase change for ink ejection. Moreover, a contact between an electric contact portion (not shown) for signal transmission formed on a carriage 203 to be described later and an electric contact portion 157 on the printing head unit 105 is established, whereby the printing signals are transmitted to an electrothermal transducer element drive circuit of the printing head 105' through a wiring portion 158. Meanwhile, a wiring portion 159 also extends from the electric contact portion 157 to the connector 152.

The ink tank 1 is handled above the holder 150 (FIG. 7A) when attaching the ink tank 1 to the printing head unit 105. Moreover, the ink tank 1 is placed on the bottom face of the holder while inserting the first engaging part 5 in the shape of a protrusion formed on a back face of the ink tank to the first locking part 155 formed on a back face of the holder (FIG. 7B). Here, when an upper end on the front face side of the ink tank 1 is pressed down as indicated with an arrow P, the ink tank 1 turns in the direction of an arrow R pivotally around a point of engagement between the first engaging part 5 and the first locking part 155, and the front face of the ink tank is gradually displaced downward. In this process, a side face of the second engaging part 6 formed on the supporting member 3 on the front face side of the ink tank is pressed by the second locking part 156, whereby the supporting member 3 is gradually displaced in the direction of an arrow Q as well.

Thereafter, when an upper face of the second engaging part 6 reaches a lower part of the second locking part 156, the supporting member 3 is disposed in the direction of an arrow Q' by its own elasticity, and the second engaging part is locked by the second locking part 156. In this state (FIG. 7C), the second locking part 156 elastically energizes the ink tank 1 in the horizontal direction through the supporting member 3, and the back face of the ink tank 1 abuts on the back face of the holder 150. Meanwhile, displacement to the upside of the ink tank 1 is suppressed by the first locking part 155 engaged with the first engaging part 5 and the second locking part 156 engaged with the second engaging part 6. This is a state where the ink tank 1 is completely attached. At this time, the ink supply port 7 is connected to the ink inlet port 107, and the pad 102 is connected to the connector 152.

Applying the principle of leverage as an example, in the process of the attaching operation as shown in FIG. 7B, the point of engagement between the first engaging part 5 and the first locking part 155 functions as a fulcrum while the front surface of the ink tank 1 functions as a power point. The point of connection between the ink supply port 7 and the ink inlet port 107 functions as a point of action, which is located between the power point and the fulcrum preferably in a position close to the fulcrum. Therefore, the ink supply port 7 is pressed against the ink inlet port 107 by a large force along with the turn of the ink tank 1. An elastic material having relatively fine flexibility such as a filter, an absorbent or a packing is usually disposed at the point of connection between the both constituents in order to ensure ink communication and to prevent ink leakage.

Therefore, it is preferable in light of the purpose of provision to adopt the configuration layout and the attaching operation of this example and to subject those members to elastic deformation by use of a relatively large force. Moreover, when the attaching operation is completed, the first locking part 155 engaged with the first engaging part 5 and the second locking part 156 engaged with the second engaging part 6 prevent the ink tank 1 from rising. Accordingly, restoration of the elastic members is suppressed, and the members are thereby retained at the elastically deformed state.

Meanwhile, the pad 102 and the connector 152 functioning as the contact points are conductive members such as metal having relatively high rigidity, and fine electric connection should be ensured between these members. On the other hand, it is not preferable to allow these members to abut on each other by applying an excessive force from the viewpoints of damage prevention and durability. In this embodiment, the abutting force is favorably reduced by locating these members in the regions as remote from the fulcrum as possible, i.e. in the vicinity of the front face of the ink tank.

To achieve this, it is conceivable to dispose the pad of the board on the bottom face of the ink tank in a region very close to the front surface. On the contrary, it is also conceivable to dispose the pad of the board on the front face of the ink tank. In any case, however, restriction arises in terms of the layout of the first light emitting portion 101 on the board for appropriately projecting the light toward the first light receiving portion 210 and to the user's eyes. Meanwhile, when the board is disposed on the bottom face of the ink tank in the region very close to the front face, the pad 102 and the connector 152 are supposed to come close while facing each other in the state immediately before completing attachment of the ink tank 1, and are connected to each other as a consequence. It is necessary to apply a large attaching force in order to achieve fine electric connection irrespective of conditions of surfaces of the both members. As a result, there is a risk of application of an excessive force to the pad and the connector. Meanwhile, in case of leakage from the point of connection between the ink supply port 7 and the ink inlet port 107, the leaking ink may flow down on the bottom surface of the ink tank and reach the point of connection between the pad and the connector. When the board is disposed on the front face of the ink tank, detachment of the ink tank from a device body may be difficult.

On the contrary, in this example, the board 100 is disposed on the inclined face located on the junction of the bottom face and the front face of the ink tank 1 for connecting the both faces to each other. Now, in the state where the pad 102 abuts on the connector 152, equilibrium of force only in terms of this abutting portion will be considered. At this time, a reaction force (a force acting upward in the vertical direction) applied from the connecter 152 to the pad 102 so as to balance with a force of attachment acting downward in the vertical direction is equivalent to a component force of actual abutting pressure (a force acting in a perpendicular direction to the inclined face) between the connector 152 and the pad 102. Therefore, when the user presses the ink tank down to a position for completing attachment, there is only a small increase in the force for attaching the ink tank to establish electric connection between the board and the connector. In addition, operability of the user is not substantially deteriorated.

Moreover, when the ink tank 1 is pressed down to the position for completing attachment (the position where the first engaging part 5 is engaged with the first locking part 155 while the second engaging part 6 is engaged with the second locking part 156), the pressure also generates a component force in the direction parallel to a flat surface of the board 100. This component force is equivalent to a force allowing the pad 102 to slide on the connector 152. Accordingly, it is possible to obtain the completely attached state while ensuring fine electric connection between the both members. Meanwhile, in this state, the electrically connected portion is located in a region higher than the bottom face of the ink tank. Accordingly, there is very little risk of the leaking ink flowing thereon. In addition, it is also possible to ensure the optical axis from the first light emitting portion 101 to the first light receiving portion 210 and to the user's eyes.

In other words, the layout configuration of the electrically connected portion as described in this example is preferred to ensure projection paths primarily when using the first light emitting portion 101 for projection onto the first light receiving portion 210 and to the user's eyes. In addition, it is possible to say that the layout configuration is suitable in terms of various aspects such as the magnitude of the attachment force for the ink tank, ensuring the state of electrical contact or protection against the leaking ink.

The configuration of the fixture for the ink tank according to the first embodiment and a relevant modified example of the present invention is not limited to the illustration in FIG. 6.

Another example will be described by use of FIGS. 8A and 8B. FIG. 8A is a perspective view showing an another configuration example of the printing head unit configured to execute a printing operation upon reception of ink supply from the ink tank as well as a carriage for embedding this printing head unit. Meanwhile, FIG. 8B is a perspective views showing the state where the printing head unit is connected to the carriage.

As shown in FIG. 8A, a printing head unit 405 of this example does not include a holder portion corresponding to the front face side of the ink tank and components arranged thereon including the second locking part and the connector unlike the holder 150 of the previous example configured to fix and hold the entire ink tank. Other features are substantially similar to the previous example. Specifically, the ink inlet port 107 to be connected to the ink supply port 7 is provided on the bottom face while the first locking part 155 is provided on the rear face side. In addition, an electric contact point (not shown) for signal transmission is provided on the rear face side thereof.

Figure 8B:
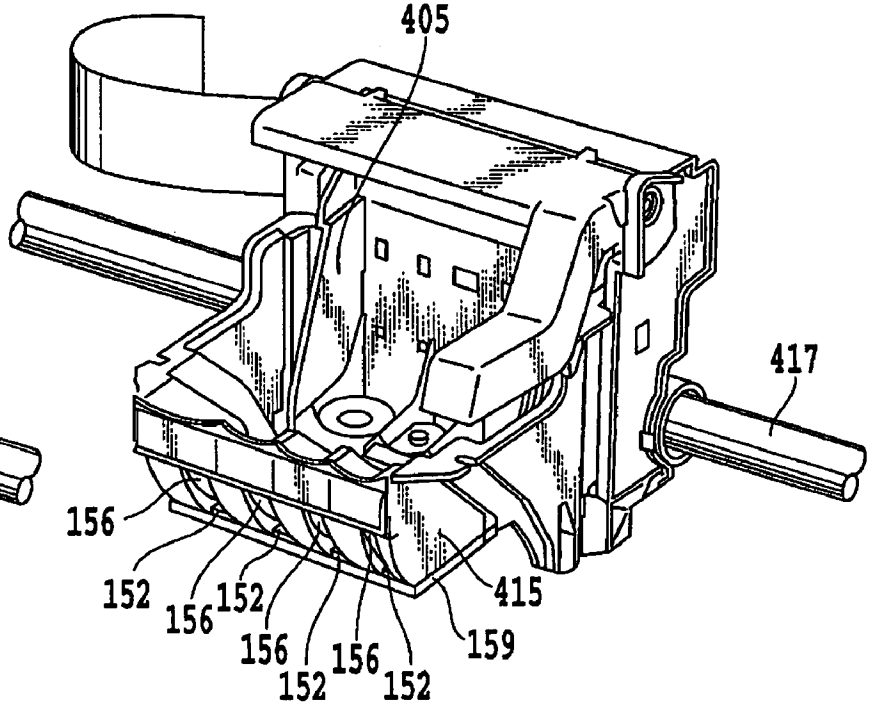
FIGS. 8A and 8B are perspective views showing another example of a structure of a fixture for the ink tanks to which the present invention is applicable.
Figure 8A:
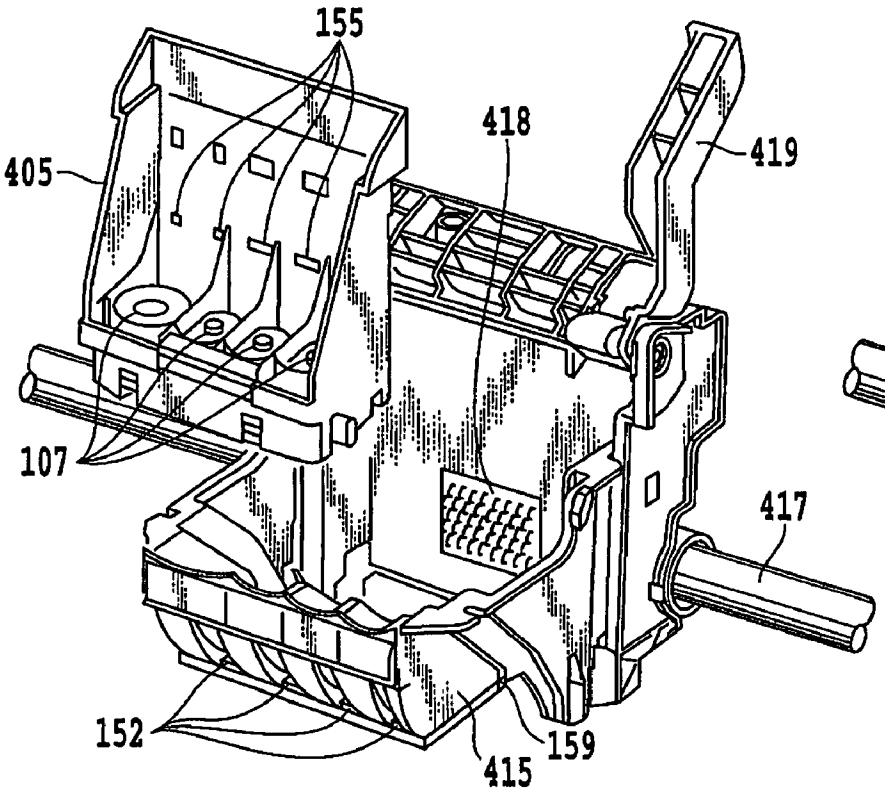

Meanwhile, as shown in FIG. 8B, a carriage 415 which is rendered movable along a shaft 417 includes a lever 419 for attaching and fixing the printing head unit 405, and an electric contact portion 418 connected to the electric contact portion on the printing head. In addition, the carriage 415 also includes a holder portion corresponding to the structure of the front face of the ink tank. Specifically, the second locking parts 156, the connectors 152, and the wiring portion 159 for the connectors are provided on the carriage.

In this configuration, the fixture for the ink tanks is constructed as a whole when the printing head unit 405 is attached to the carriage 415. That is, an attaching operation is completed by connecting the ink supply port 7 to the ink inlet port 107 while the pad 102 is connected to the connector 152 by way of an attaching operation similar to FIGS. 7A to 7C.

1.3. Printing Device (FIGS. 9 and 10)

Figure 9:
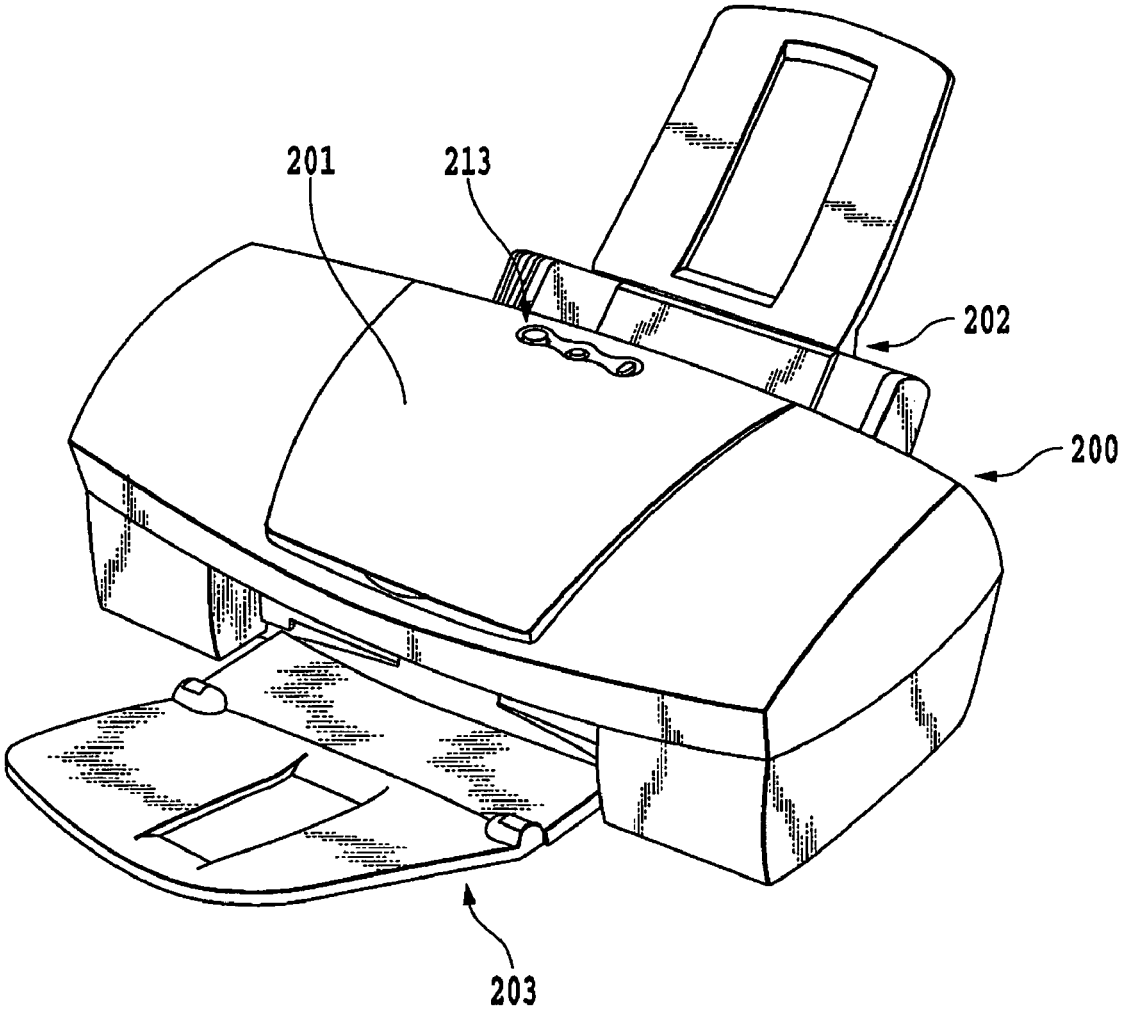
FIG. 9 is a view showing appearance of an ink jet printer configured to perform printing while attaching the ink tanks to which the present invention is applicable.
Figure 10:
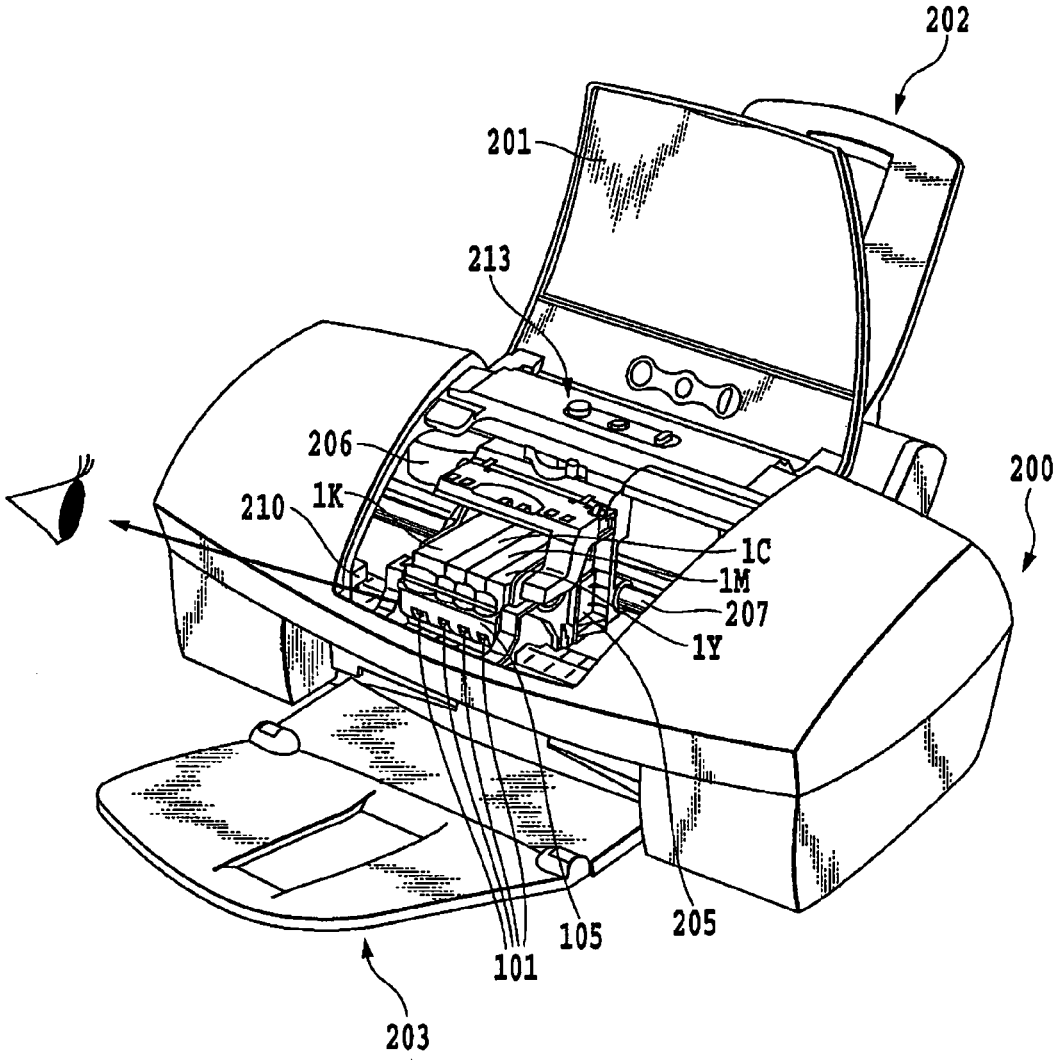
FIG. 10 is a perspective view showing a state where a body cover 201 illustrated in FIG. 9 is open.

FIG. 9 is a view showing appearance of an ink jet printer 200 configured to perform printing while attaching the above-described ink tanks, and FIG. 10 is a perspective view showing a state where a body cover 201 illustrated in FIG. 9 is open.

As shown in FIG. 9, the printer 200 of this embodiment includes a printer body constituting a principal part of the printer including a mechanism for allowing the carriage mounting the printing head and the ink tanks to travel for scanning and to execute printing. The printer body is covered with the body cover 201 and other casing portions. Moreover, the printer 200 of this embodiment includes a sheet-discharge tray 203 and an automatic sheet feeder (ASF) 202 which are respectively placed in front and back of the printer body. Further, the printer 200 includes a console unit 213. Here, the console unit 213 includes an indicator for indicating the condition of this printer both in the state where the body cover is closed and in the state where the body cover is open, a power switch, and a reset switch.

When the body cover 201 is open, as shown in FIG. 10, the user can observe a moving range of the carriage 205 mounting the printing head unit 105 and ink tanks 1K, 1Y, 1M, and 1C, and the surrounding area of that range. In the following, the ink tanks 1K, 1Y, 1M, and 1C may be indicated with a single reference numeral of "1" when appropriate. Actually, when the body cover 201 is open, a sequence for moving the carriage 205 automatically to a substantially central position in the drawing (this position will be hereinafter referred to as a "tank replacement position") is executed, whereby the user can perform replacing operations of the respective ink tanks and the like in this tank replacement position.

In the printer of this embodiment, the printing head unit 105 includes chip-shaped printing heads (not shown) corresponding to the respective colors of ink. Moreover, the printing heads for the respective colors perform scanning on a printing medium such as paper by means of movement of the carriage 205, and perform printing by ejecting the ink onto the printing medium in the course of scanning. Specifically, the carriage 205 is slidably engaged with a guide shaft 207 extending in the direction of movement thereof, and is able to move as described above by use of a carriage motor and a drive force transmission mechanism thereof. Then, ink ejection is performed by the respective printing heads corresponding to the ink in the colors of K. Y, M, and C based on ejection data transmitted from a control circuit on the body's side through a flexible cable 206. Meanwhile, paper feeding mechanisms including a paper feed roller and a paper discharge roller are provided, and it is thereby possible to convey the printing medium (not illustrated) fed from the automatic sheet feeder 202 to the sheet-discharge tray 203. Moreover, the printing head unit 105 incorporating the ink tank holder is detachably attached to the carriage 205. Meanwhile, each of the ink tanks 1 is detachably attached to this printing head unit 105 in the form of a cartridge. That is to say, it is possible to attach the printing head unit 105 to the carriage 205 and further to attach the ink tanks 1 to the printing head unit 105. In this embodiment, the ink tanks 1 are detachable from the carriage 205 through the printing head unit 105. Moreover, a liquid supply system according to an embodiment of the present invention is constructed by attaching the ink tanks 1 to the printing head unit 105.

In the printing operation, the printing heads perform scanning by means of the above-described movement. In the course of scanning, the respective printing heads eject the ink onto the printing medium and thereby perform printing in a region of width corresponding to nozzles in the printing heads. Then, at an interval between this scanning operation and the next scanning operation, the paper is sent in a given amount corresponding to the width by the paper feeding mechanisms, whereby the printing medium is sequentially printed. Meanwhile, on an end in the moving range of the printing heads attributable to the above-described cartridge movement, there is provided an ejection recovery unit such as caps for covering faces of the respective printing heads on which the nozzles are formed. In this way, the printing heads move to the position where the recovery unit is provided at a given time interval and are subjected to a recovery process such as preliminary ejection.

As described previously, the printing head unit 105 including tank holder portions for the respective ink tanks 1 is provided with the connectors corresponding to the respective ink tanks. Each of the connectors contacts the pad on the board provided on the ink tank 1 to be attached thereto. In this way, it is possible to control lighting or blinking of each LED 101 in accordance with sequences to be described later with reference to FIG. 17 to FIG. 23D.

To be more precise, in the above-described tank replacement position, the LED 101 of the ink tank is either turned on or caused to blink when ink residual quantity of the relevant ink tank 1 is reduced. Meanwhile, the first light receiving portion 210 including a photodetector is provided in the vicinity of an end in the moving range of the carriage on the opposite side of the position where the above-described recovery unit is provided. Then, the LEDs 101 of the respective ink tanks 1 are subjected to light emission when the LEDs 101 pass this light receiving portion 210 along with the movement of the carriage 205. In this way, it is possible to detect positions of the respective ink tanks 1 in the carriage 205 based on the position of the carriage 205 at the time of receiving the light. In addition, as another example of controlling blinking and the like of the LEDs, the LED 101 of each of the ink tanks 1 is controlled to blink when the ink tank 1 is properly attached. These control operations are executed as similar to the control for ink ejection from the printing heads, namely by transmitting control data (control signals) from the control circuit on the body to the respective ink tanks through the flexible cable 206.

2. Structure of Control System 2.1. Overall Structure (FIG. 11)

Figure 11:
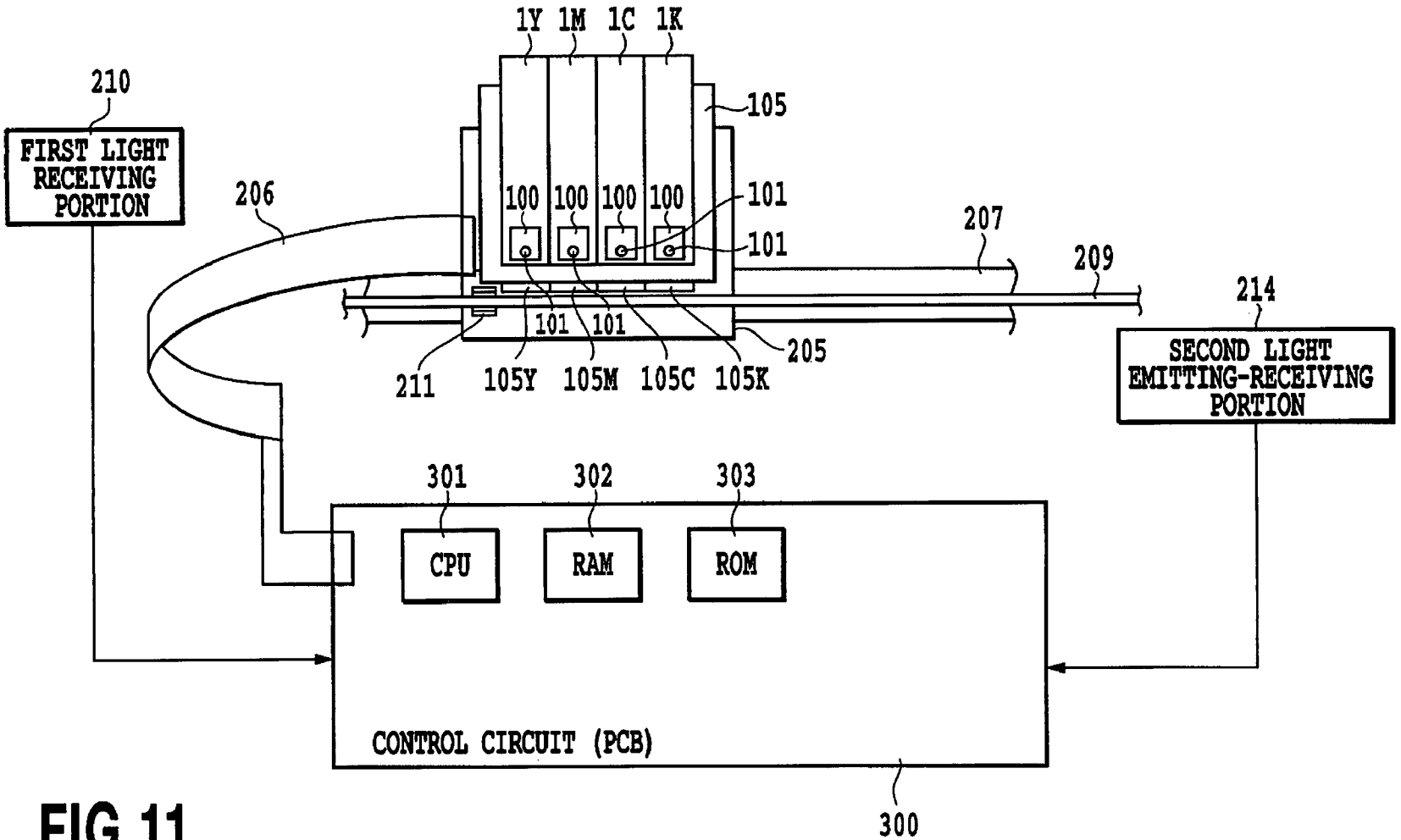
FIG. 11 is a block diagram showing a control structure of the ink jet printer.

FIG. 11 is a block diagram showing an example of a structure of control system for the above-described ink jet printer. This drawing mainly illustrates a control circuit in the form of a printed circuit board (PCB) in the printer body, and a structure concerning light emission of the first light emitting portion (hereinafter also referred to as the LED) of the ink tank to be controlled by the control circuit.

In FIG. 11, a control circuit 300 executes data processing and operation control concerning the printer. To be more precise, a central processing unit (CPU) 301 executes the processing to be described later with reference to FIG. 17 to FIG. 20 and FIG. 24, and the like in accordance with a program stored in a read-only memory (ROM) 303. Meanwhile, a random access memory (RAM) 302 is used as a work area during execution of the processing by the CPU 301.

As schematically illustrated in FIG. 11, the printing head unit 105 mounted on the carriage 205 includes printing heads 105K, 105Y, 105M, and 105C. Each of the printing heads 105K, 105Y, 105M, and 105C is provided with a plurality of nozzles for ejecting the ink in any of black (K), yellow (Y), magenta (M), and cyan (C). Moreover, the ink tanks 1K, 1Y, 1M, and 1C are detachably mounted on the holder of the printing head unit 105 corresponding to these printing heads. Here, it is needless to say that the numbers of the colors and the ink tanks are not limited to the foregoing example, and that different density types of the ink in the same color group are also applicable.

As described above, the board 100 provided with the LED 101, the display control circuit therefor, and the pad functioning as a contact terminal are mounted on each of the ink tanks 1. Moreover, when the ink tank 1 is properly attached to the printing head unit 105, the pad on the board 100 contacts the connector provided on the printing head unit 105 corresponding to each of the ink tanks 1. Meanwhile, a connector (not shown) provided on the carriage 205 is subjected to signal connection to the control circuit 300 on the body through the flexible cable 206. In addition, as the printing head unit 105 is attached to the carriage 205, the connector of the carriage 205 is subjected to signal connection to the connector of the printing head unit 105. By the above-described configuration of connection, it is possible to transmit signals between the control circuit 300 on the body and the respective ink tanks 1. In this way, the control circuit 300 can control lighting and blinking in accordance with the sequences to be described later with reference to FIG. 17 to FIG. 23D.

Ink ejection of the respective printing heads 105K, 105Y, 105M, and 105C is similarly controlled. Specifically, drive circuits and the like that are provided on the respective printing heads are subjected to signal connection to the control circuit 300 on the body through the flexible cable 206, the connector of the carriage 205 and the connector of the printing head unit. In this way, the control circuit 300 can control ink ejection and other operations by the respective printing heads.

The first light receiving portion 210 provided in the vicinity of one end in the moving range of the carriage 205 receives the light emitted from the LED 101 of the ink tank 1 and then outputs a corresponding signal to the control circuit 300. As will be described later, the control circuit 300 can determine the position of each of the ink tanks 1 relative to the carriage 205 based on this signal. Meanwhile, an encoder scale 209 is provided along the moving path of the carriage 205, and an encoder sensor 211 is provided on the carriage 205. A detection signal of this sensor is inputted to the control circuit 300 through the flexible cable 206. In this way, it is possible to determine the moving position of the carriage 205. This positional information is used for ejection control of the respective printing heads and in an optical checking process for detecting the positions of the ink tanks to be described later with reference to FIG. 17 and the like. In addition, a second light emitting-receiving portion 214 to be placed in the vicinity of a given position within the moving range of the carriage 205 includes a light emitting element and a photodetector and outputs signal concerning the ink residual quantity in terms of each of the ink tanks 1 to be mounted on the carriage 205 to the control circuit 300. Accordingly, the control circuit 300 can detect the ink residual quantity based on this signal.

2.2. Structures of Connectors (FIG. 12)

Figure 12:
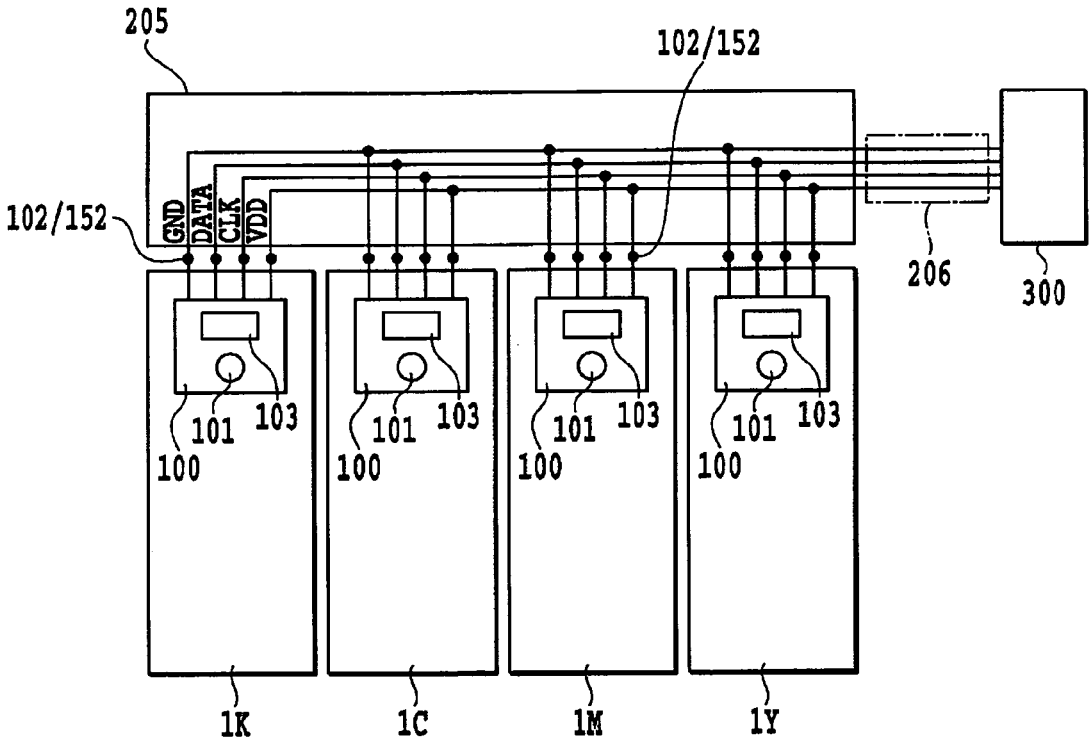
FIG. 12 is a view showing structures of signal lines in a flexible cable of the ink jet printer used for signal connection to the ink tanks, which is illustrated in terms of relations with boards on the respective ink tanks.

FIG. 12 is a view showing structures of signal lines in the flexible cable 206 used for signal connection to the ink tanks 1, which is illustrated in terms of relations with boards 100 on the respective ink tanks.

As shown in FIG. 12, the signal lines for the ink tank 1 consist of four signal lines. Moreover, these signal lines are shared by the four ink tanks 1 (so-called bus connection). Specifically, the signal lines for the respective ink tanks 1 include a power signal line "VDD" involved in power supply for operations and the like of the control portion 103 configured to perform light emission and drive control of the first light emitting portions (the LEDs 101) in the ink tanks, and a ground signal line "GND". Moreover, as will be described later, the signal lines include a signal line "DATA" for transmitting control signals (control data) concerning lighting and blinking processes of the LEDs 101 from the control circuit 300, and a clock signal line "CLK" for the operations. Although this embodiment will be described on the basis of the four signal lines, the present invention is not limited to this configuration. For example, it is possible to omit the "GND" line by achieving the ground signal by use of a different structure. Moreover, it is also possible to use the single line as the "CLK" signal line and as the "DATA" line.

On the other hand, the board 100 of each of the ink tanks 1K, 1Y, 1M, and 1C includes the control portion 103 to be operated by the signals from these four signal lines, and the LED 101 as the light emitting portion to be operated under control by the control portion 103. The above-described structure is one of configurations to minimize the number of connection terminals for the ink tanks. In this structure, it is possible to control the LED 101 and to acquire and/or update ink tank information by use of drive timing charts to be described with reference to FIGS. 15 and 16.

2.3. Structure of Control Portion (FIGS. 13A, 13B and 14)

Figure 13A:
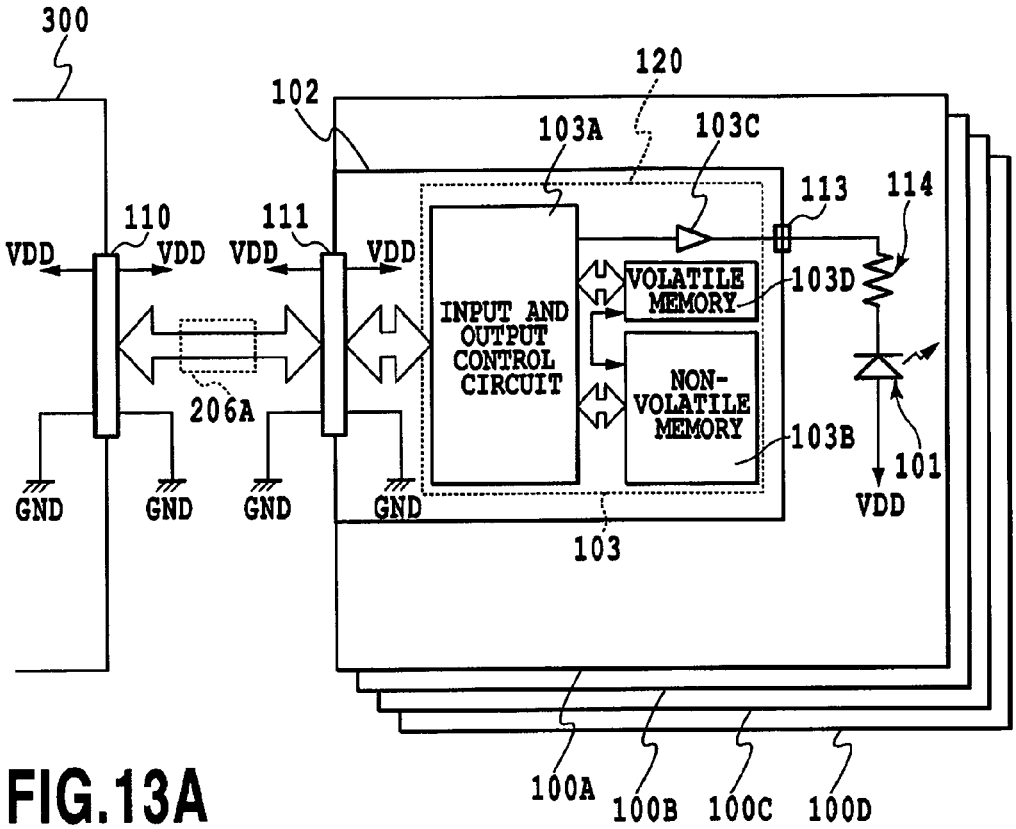
FIG. 13A is a circuit diagram showing details of the board provided with a control portion and the like, and FIG. 13B is a view schematically showing a non-volatile memory, a volatile memory, and in particular, a portion of an input and output control circuit used for controlling memory access, which are shown in FIG. 13A.
Figure 13B:
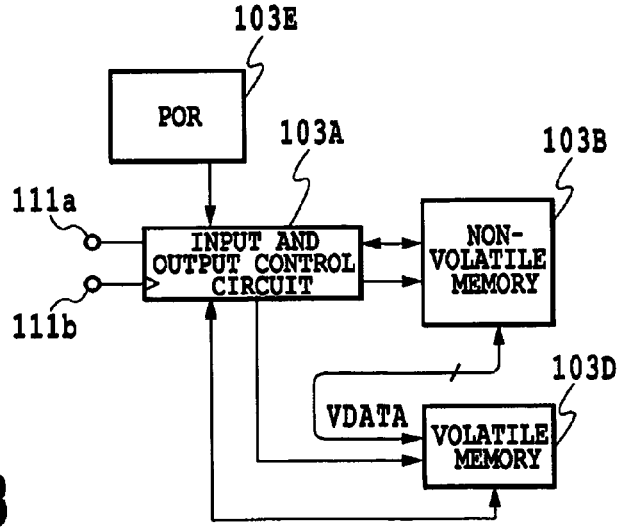
Figure 14:
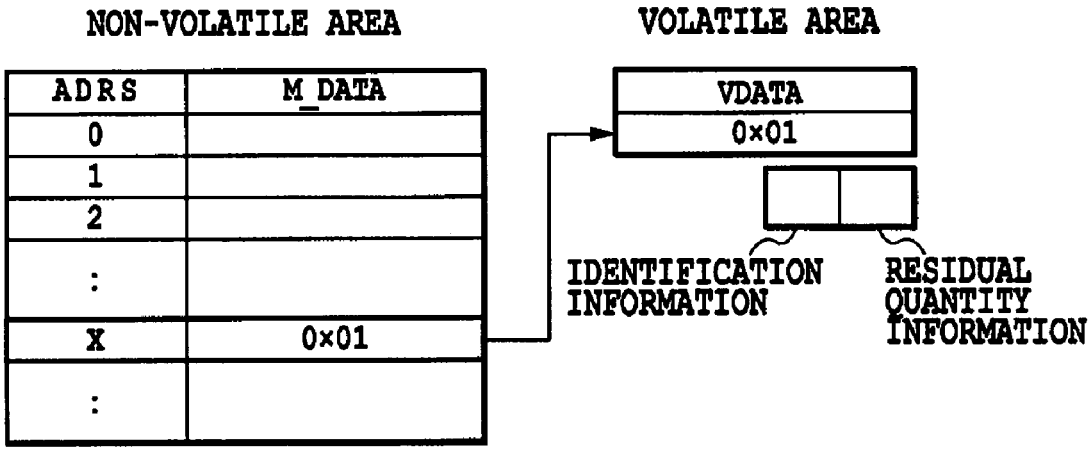
FIG. 14 is a view for explaining a process from making reference to a specific address in the volatile memory in FIG. 13B to latching given information stored in the specific address on the volatile memory.

FIG. 13A is a circuit diagram showing details of the board according to an embodiment provided with the control portion and the like to which the present invention is applicable. This embodiment will be described on the assumptions that the ink tank is equivalent to a cartridge, that the ink is equivalent to a printing agent, and that a light emitting diode (LED) is equivalent to the light emitting portion. As shown in the drawing, each of the control portions 103 located in boards 100A to 100D on the ink tanks includes a semiconductor substrate 120. The substrate 120 mounts a non-volatile memory 103B, a volatile memory 103D, an LED driver 103C, and an input and output control circuit 103A for controlling the memory 103B, the memory 103D, and the LED driver 103C. The non-volatile memory 103D is formed by use of a non-volatile memory element, and constitutes a non-volatile information retention portion. The volatile memory 103D is able to retain at least part of stored contents in a non-volatile information retention area, and constitutes a volatile information retention portion. The LED driver 103C and the input and output control circuit 103A constitute a drive portion and a control portion, respectively.

The input and output control circuit 103A controls display drive of the LED 101 via the LED driver 103C for executing an informing operation in response to the control data to be transmitted from the control circuit 300 on the body through the flexible cable 206. Moreover, the input and output control circuit 103A controls data writing and reading in and out of the non-volatile memory 103B. Note that FIG. 13A is merely the block diagram and therefore illustrates simplified signal connection between the control circuit 300 on the body and the board 100A on the ink tank. However, in reality, the control data sent from a control signal connector 110 on the body through the flexible cable 206 are not transmitted directly to the boards 100A to 100D on the ink tanks. Actually, the control data are transmitted through the electric contact portion formed on the carriage 205 for signal transmission, the electric contact portion 157 provided on the printing head unit 105, and the like. Moreover, in FIG. 13A, the signal lines concerning "DATA" and "CLK" as described above are collectively denoted by reference numeral 206A.

In this embodiment, the non-volatile memory 103B is an EEPROM which can store the ink residual quantity, color information on the contained ink, manufacturing information of the ink tank such as a specific number or a manufacturing lot number, and the like. Here, the non-volatile memory 103B as an information storage portion can be also formed by use of other types of non-volatile memory element such as a flash memory or a ferroelectric RAM.

The color information to be stored in the non-volatile memory 103B is written into a predetermined address in the non-volatile memory 103B corresponding to the ink color at the time of shipping or the manufacturing the ink tank. As will be described later with reference to FIG. 15 and FIG. 16, this color information is used as identification information of the ink tank. By using this identification information, it is possible to write the data in the non-volatile memory 103B in the specified ink tank or to read the data out of the non-volatile memory 103B. Moreover, it is possible to control lighting and blinking of the LED 101 of the relevant ink tank.

In addition, the data to be written in or read out of the non-volatile memory 103B further include data on the ink residual quantity. As described previously, the detection target 17 in the prism shape is formed on the bottom of the ink tank of this embodiment. When the ink residual quantity is reduced, it is possible to optically detect such reduction by use of this detection target 17. In addition, in this embodiment, the control circuit 300 counts the number of ejection depending on the printing head based on ejection data, and calculates the ink residual quantity in each of the ink tanks based on the counted number of ejection. Thereafter, the control circuit 300 writes this residual quantity information severally in the non-volatile memory 103B in the corresponding ink tank and reads out the information therefrom. In this way, the non-volatile memory 103B can retain the present-time information on the ink residual quantity. This information may be used for detection of the residual quantity at higher accuracy by a combination of the ink residual quantity detection applying the detection target 17 in the prism shape, or for judging as to whether the attached ink tank is a new one or a reattached one, for example.

The LED driver 103C is operated to apply a power voltage to the LED 101 when an on signal is outputted from the input and output control circuit 103A, thereby allowing the LED 101 to emit the light. Therefore, the LED 101 continues to be turned on when the signal outputted from the input and output control circuit 103A is set to an on-state. On the contrary, the LED 101 continues to be turned off when the signal is set to an off-state.

Reference numeral 113 denotes a terminal for connecting a cathode side of the LED 101 to the LED driver 103C of the semiconductor substrate 120. Reference numeral 114 denotes a limiting resistor for defining a current to flow on the LED 101, which is interposed between the LED driver 103C and a cathode of the LED 101.

Here, the limiting resistors 114 may be mounted on the respective boards 100A to 100D on the ink tanks as shown in the drawing. Alternatively, the limiting resistors 114 may be formed in the semiconductor substrates 120.

It is also possible to apply a structure configured to connect an anode side of the LED 101 to the LED driver 103 of the semiconductor substrate 120 and to connect the cathode side of the LED 101 to a ground line of the semiconductor substrate 120. However, in the structure applying a power voltage to the LED 101, the structure shown in FIG. 13A configured to supply the power from a VDD power source pattern provided inside the board 100 of the ink tank has the following advantage. Specifically, the respective elements constituting the control portion 103 are generally formed on the semiconductor substrate 120 in a lump. Meanwhile, in FIG. 13A, the connection terminal on the semiconductor substrate 120 to be connected to the LED 101 consists of the single connection terminal 113. Reduction of just one connection terminal has a large impact on the occupied area of the semiconductor substrate 120. Accordingly, it is possible to achieve cost reduction of the semiconductor substrate 120.

FIG. 13B shows a circuit configuration of the memories 103B and 103D as well as the surroundings thereof. Reference numeral 111*a* denotes a data terminal of the input and output control circuit 103A, which is connected to a data bus located on a communication line between the printing apparatus and the ink tank. Reference numeral 111*b* denotes a clock terminal of the input and output control circuit 103A, which receives a data transfer clock transmitted from the printing apparatus. The input and output control circuit 103A transmits a command for driving the LED 101 or a command for performing memory access by using these two types of signals.

In this embodiment, the volatile memory 103D is a register formed by combining logic circuits. The capacity thereof only needs to have a sufficient number of bits for temporarily retaining necessary data. For example, when retaining the identification information of the ink tanks, the capacity only may be relevant to the maximum number to be attached to the carriage of the printing apparatus. Specifically, two bits are satisfactory when the number of ink colors and the number of the ink tanks applied to the recording device are equal to 4. Meanwhile, other necessary data include the ink residual quantity. The identification information on the ink cartridge is necessary for selecting the relevant ink tank when drive-controlling the LED 101. Moreover, the ink residual quantity information is required for informing the timing for replacement relevant to the ink residual quantity information. The ink residual quantity information requires only 2 bits on the assumption that such information has three types corresponding to "when there is sufficient ink residual quantity," "when there is small ink residual quantity," and "when there is substantially no ink residual quantity," for example. In this case, a control command corresponding to the relevant information may be transmitted from the control circuit 300 on the body.

It is a characteristic of this embodiment not to access the non-volatile memory 103B when a user can replace the ink tank, but to allow access only to the volatile memory 103D that stores the essential content temporarily. In this way, it is possible to prevent destruction of the contents stored in the non-volatile memory 103B and destruction of the non-volatile memory 103B in itself.

The timing for allowing a storage area (the register) of the volatile memory 103D to retain the information temporarily may be configured as follows. For instance, a command for transferring desired information is transmitted from the control circuit 300 on the body to the input and output control circuit 103A as appropriate (when opening the cover of the printing apparatus, for example), and the command can be used as a trigger. Alternatively, as shown in the drawing, timing generated by a power-on-reset circuit (POR) 103E that responds to the time when the device is turned on is used for generating a trigger for causing the input and out put control circuit 103A to transfer the desired information from a non-volatile area to a volatile area in conformity therewith. The latter example will be described in detail in a second embodiment.

Here, when the information supposed to be stored temporarily is gathered in a specific address in the non-volatile memory 103B, it is possible to latch the data bus relative to this address in a lump onto the volatile memory 103D in line with the trigger signal. This is an efficient method. Afterwards, it is possible to make reference to the information retained by the volatile memory 103D until the ink tank is detached (as long as the power is supplied).

FIG. 14 shows a process of making reference to a specific address X in the non-volatile memory 103B and latching the information onto the volatile memory 103D. Here, an assumption will be made that data "0x01" is stored at the address X in terms of a memory map of the non-volatile memory 103B, for example. When allocating the ink tank identification information and the ink residual quantity information to this low-order 4 bits, a combination of the pre antepen ultimate and antepen ultimate bits "0x" from a LSB constitutes cartridge identification information while a combination of last two bits "01" constitutes the ink residual amount information. As described previously, assuming that there are three types of information, namely, "when there is sufficient ink residual quantity," "when there is small ink residual quantity," and "when there is substantially no ink residual quantity," and that these three types are expressed by "11," "10," and "01," respectively, then, the ink residual quantity information shown in FIG. 14 corresponds to "when there is substantially no ink residual quantity."

In terms of this ink residual quantity information, the control circuit 300 on the body calculates an amount of consumption of the ink in accordance with the number of print control operations, and updates and saves the information in the non-volatile memory 103B. Then, the information is transferred to the volatile memory 103D at the time of opening the cover of the printing apparatus, for example. As a result of this operation, the volatile memory 103D is updated with the most recent ink residual quantity information when the user can directly detach the ink tank. Therefore, it is possible to issue an information corresponding to the most recent ink residual quantity even when the ink tank is detachable. Moreover, since there is no access to the non-volatile memory 103B in this state, it is possible to prevent erroneous destruction of the information in the non-volatile area due to hot-swap or the like.

2.4. Operations of Control Portion (FIGS. 15 and 16)

Figure 15:
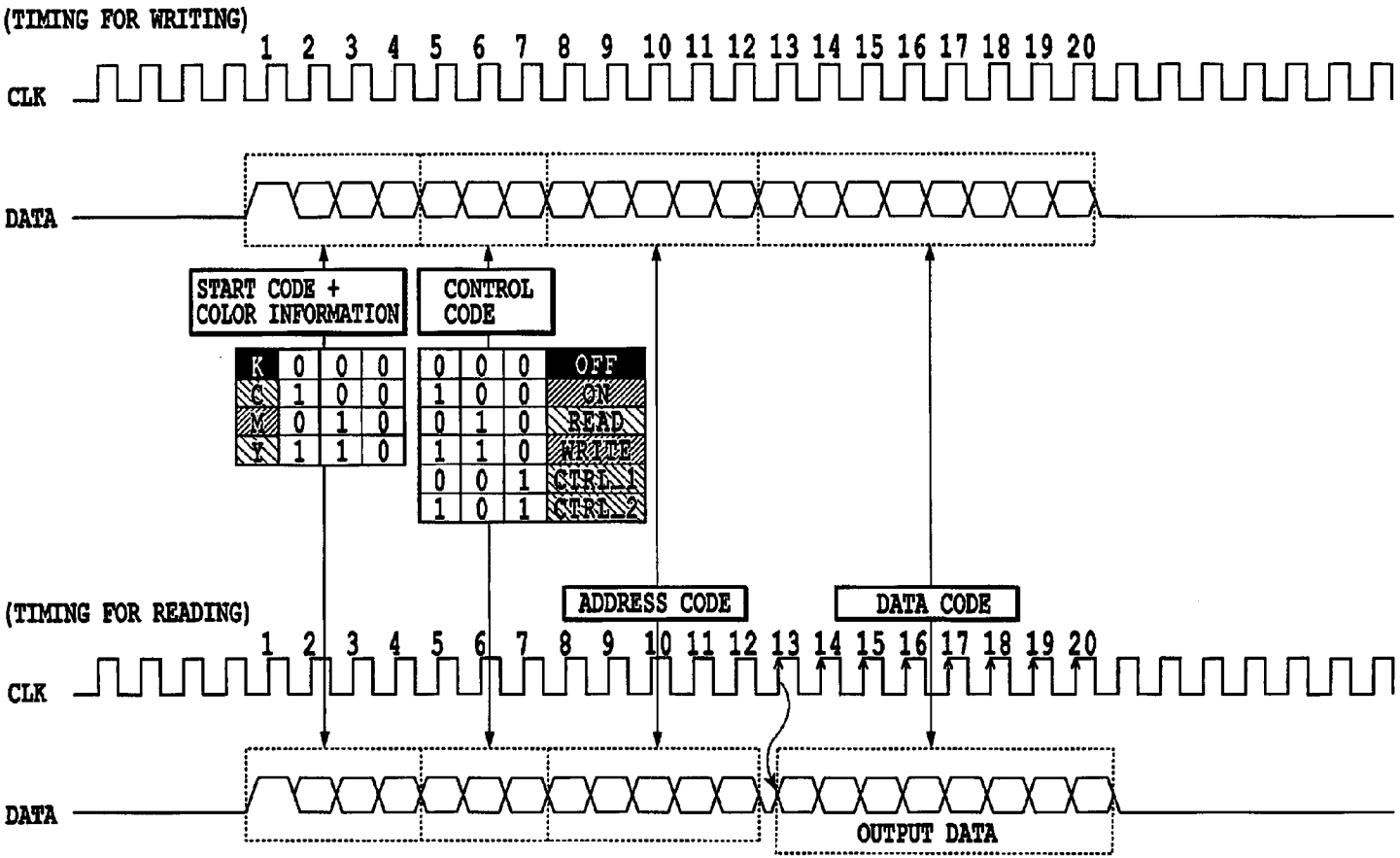
FIG. 15 is a timing chart for explaining operations for writing and reading data in and out of the non-volatile memory of the board.
Figure 16:
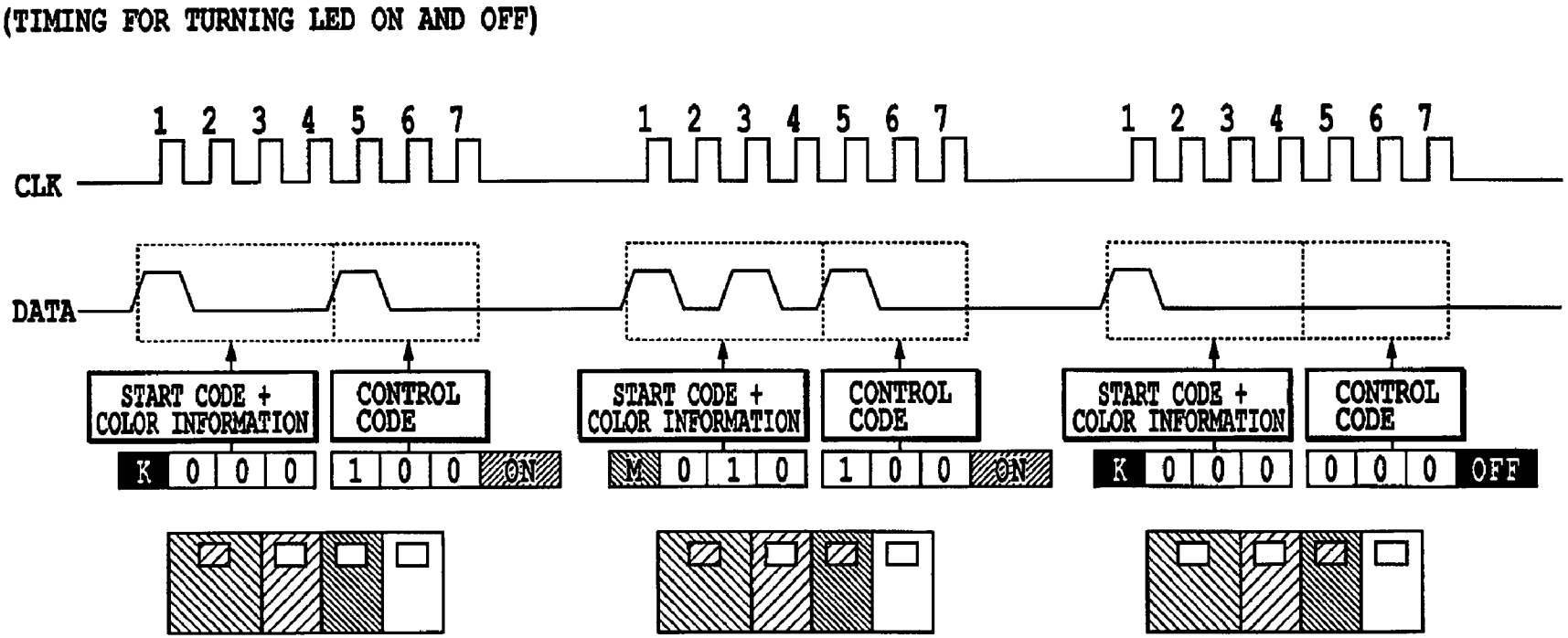
FIG. 16 is a timing chart for explaining operations for turning an LED 101 on and off.

FIG. 15 is a timing chart for explaining operations for writing and reading data in and out of the above-described non-volatile memory 103B and FIG. 16 is a timing chart for explaining operations for turning the LED 101 on and off.

As shown in FIG. 15, when writing in the non-volatile memory 103B, the following data signals are sent from the control circuit 300 on the body to the input and output control circuit 103A in the control portion 103 of the ink tank 1 through the signal line DATA (see FIG. 12). Specifically, the respective data signals representing "start code+color information," "control code," "address code," and "data code" are sent in this order synchronously with a clock signal CLK.

The "start code+color information" signifies a start of a series of data signals by use of the "start code" signal therein, and specifies the ink tank subject to the series of data signals by use of the "color information" signal. These signals are added in common both in the case of accessing any of the non-volatile memory 103B and the volatile memory 103D and in the case of controlling to turn the LED 101 on and off. Meanwhile, the clock signal CLK is constantly outputted as a reference clock to be used both in the case of performing memory access and in the case of determining a blink cycle of the LED 101 to be described later.

As shown in the drawing, the "color information" includes codes corresponding to the ink colors of "K," "C," "NM," or "Y." The input and output control circuit 103A compares the color information indicated by any of the above codes with its own color information stored in the non-volatile memory 103B. Then, the input and output control circuit 103A performs a process to retrieve subsequent data signals only when two pieces of the color information coincide with each other. When the two pieces of the color information do not coincide with each other, the input and output control portion 103A performs a process to stop or ignore subsequent data signals. In this embodiment, the "color information" corresponds to "individual information from the printing apparatus." In this way, even when the data signals are transmitted from the body to the respective ink tanks in common by use of the common signal line "DATA," it is possible to specify the relevant ink tank by incorporating the above-described color information. Therefore, it is possible to execute various processes such as writing, reading or turning the LED on and off based on the subsequent data signals only in terms of the specified ink tank. As a result, it is possible to perform control for turning the LED on and off in addition to data writing by use of the data transmitted through the common (single) data signal line provided for four ink tanks, and thereby to reduce the number of signal lines required for controlling these ink tanks. Here, it is obvious from the foregoing explanation that the structure applying the common (single) data signal line can be similarly embodied irrespective of the number of ink tanks.

Then, in the writing operation to the non-volatile memory 103B, the writing operation is instructed by a "WRITE" code which is a control code subsequent to the "color information." Thereafter, an address in the non-volatile memory 103B is designated as a writing destination by a subsequent address code. Further, data having a content represented by the last data code is written in the address synchronously with a rising edge of the first clock (which is the 13th clock in FIG. 15) after completion of the address code.

In the reading operation from the non-volatile memory 103B, the structure of the data signals is the same as the above-described writing operation. Moreover, the code "start code+color information" is retrieved by the input and output control circuits 103A of all the ink tanks as similar to the above-described wiring operation, and the subsequent data signals are retrieved only by the input and output control circuit 103A of the ink tank having the corresponding "color information." This operation is different from the writing operation in that the data are read out or outputted after designating the address by the address code, synchronously with a rising edge of the first clock (which is the 13th clock in FIG. 15) after completion of the address code.

Furthermore, in this embodiment, codes "CTRL_1" and "CTRL_2" are prepared as the "control codes" for memory access.

Now, by using the command with addition of the "CTRL_1" code, it is possible to transfer part of the information in the non-volatile memory 103B to the volatile memory 103D at arbitrary timing without the subsequent "address code." It is possible to designate the respective ink tanks sequentially in order to cause all the mounted ink tanks to perform this operation. Alternatively, when the control portion 103 and the input and output control portion 103A of any of the ink tanks analyzes existence of the "CTRL_1" code subsequent to the "color information," it is possible to perform an operation irrespective of whether or not the "color information" designates the ink tank. In any case, when the "CTRL_1" code is issued at the timing of opening the cover of the printing apparatus, the volatile memory 103D is supposed to be updated with the most recent information when the ink tank becomes detachable as described above.

The "CTRL_2" code is added to the "start+color information" code in order to read the information in the volatile memory 103D which is updated as described above. It is possible to acquire the most recent information on an arbitrary ink tank by use of this code. This code is only different from the "READ" code for reading the information out of the non-volatile memory 103B in that the code does not require address designation. Accordingly, the information is outputted at the timing of the "data code." The control circuit 300 on the body can perform display in conformity with the most recent information when performing the drive control of the LED 101 in terms of the ink tank next time.

As described above, even when the data signal terminals of the plurality of ink tanks are connected to the common (single) data signal line, the input and output control circuits 103A arbitrate the data traffic to avoid conflicts between the readout data and other input signals.

Here, it is needless to say that the contents to be represented by the "control codes" for memory access are not limited only to the foregoing examples. For example, it is also possible to use an additional control code concerning a "verify" command, a "continuous read" command or the like.

Next, when turning the LED 101 on and off, as shown in FIG. 16, the data signal "start code+color information" is firstly sent from the body to the input and output control circuit 103A through the signal line "DATA" as similar to the foregoing operation. As described previously, the ink tank is specified by the "color information" and the control for turning the LED 101 on and off designated by the "control code" to be transmitted later is executed only in terms of the specified ink tank. As shown in FIG. 15, the "control code" concerning tuning on an off includes an "ON" code and an "OFF" code. The LED 101 is turned on by the "ON" code and turned off by the "OFF" code. That is, when the control code is equivalent to the "ON" code, the input and output control circuit 103A outputs an on signal to the LED driver 103C as described previously in FIG. 13A and maintains that output state thereafter. On the contrary, when the control code is equivalent to the "OFF" code, the input and output control circuit 103A outputs an off signal to the LED driver 103C and maintains that output state thereafter. Here, actual timing for tuning the LED 101 on or off takes place after the first clock (which is the 8th clock in FIG. 15) after completion of the control code in terms of each data signal shown in FIG. 16.

In the example shown in the drawing, the ink tank containing the black ink K is specified in the beginning as represented by the data signal on the left end in the drawing. Accordingly, the LED 101 of the tank for the ink K is turned on. Next, the "color information" in the second data signal designates the magenta ink M and the "control code" thereof instructs to turn the LED 101 on. Therefore, the LED 101 of the tank for the ink M is turned on while leaving the LED 101 of the tank for the ink K turned on as well. Moreover, in the third data signal, the "control code" instructs to turn the LED 101 off in terms of the ink tank for the ink K. Therefore, only the LED 101 of the tank for the ink K is turned off.

As it is apparent from the foregoing explanation, blink control of the LED is made possible by transmitting the data signals respectively including the "control codes" for turning the LED on and off while specifying the target ink tank. In this case, it is possible to control a blink cycle by defining a cycle of transmission of the signals. As described previously, printers today are apt to apply a larger number of ink colors. However, it is desirable to provide a user with similar display (such as blinking at the same interval) irrespective of the number of ink tanks to avoid confusion. In other words, it is desirable to provide the similar display irrespective of whether the printer applies a relatively small number of ink tanks (in two colors, for example) or a relatively large number of ink tanks (in four colors, for example). In this way, even when the number of the control portions 103 subject to control by the single signal line is increased as a result of an increase in the number of the ink tanks, for example, it is strongly recommended to set a short blink cycle or short timing for defining the turning on and turning off.

As it is obvious from the foregoing explanation, a format of the access commands for the non-volatile memory 103B and a format of the commands used for control to turn the LEDs on and off are separately prepared in this embodiment. Moreover, in the command used for control to turn the LEDs on and off, a command length used for control to turn the LED on and off is reduced by curtailing the "address code" and the "data code" which are only required in the control code for the non-volatile memory 103B. In this way, it is possible to supply the commands used for control to turn the LEDs on and off in a short cycle, and thereby to effectuate blinking at a short cycle even in the case of using many ink tanks.

2.5. Control Procedures (FIGS. 17 to 24)

Figure 17:
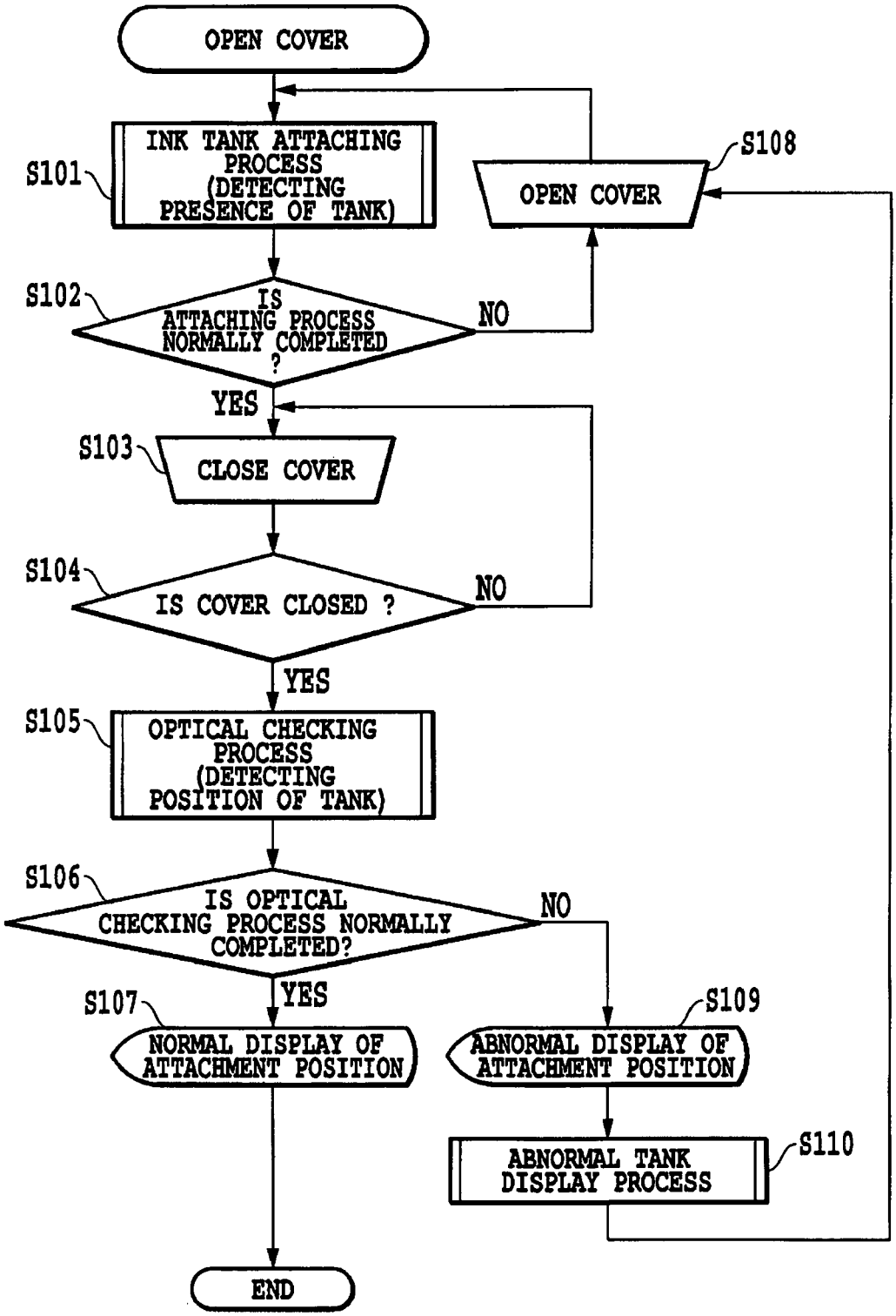
FIG. 17 is a flowchart showing control procedures for attaching an ink tank according to an embodiment of the present invention.

FIG. 17 is a flowchart showing control procedures for attaching or replacing the ink tank based on the configuration of the above-described embodiment. More specifically, FIG. 17 shows control for tuning the respective LEDs 101 for the ink tanks 1K, 1Y, 1M, and 1C on and off by use of the control circuit 300 on the body.

When the user opens the body cover 201 (see FIGS. 9 and 10) of the printer of this embodiment, a predetermined sensor detects such an action and initiates the process shown in FIG. 17. Upon initiation of this process, an ink tank attaching process is firstly executed in Step S101 (to be described in detail with reference to FIGS. 18 to 21A) together with a judgment of appropriateness concerning the state of attachment of the ink tank 1 (i.e., whether or not the ink tank 1 is completely attached). This process takes place when attaching a new ink tank or when replacing the ink tank in response to display informing no ink in the course of procedures of a printing process (see FIG. 24) to be described later, for example. Moreover, in addition to the case associated with attachment or detachment of the ink tank, it is also possible to execute this process when the user opens the body cover 201 for some reason.

When this ink tank attaching process is completed, a judgment is made in Step S102 as to whether or not the attaching process is completed normally. In the case of the judgment of abnormal completion of the process, an opening action by the user to open the body cover 201 is awaited in Step S108. When the cover 201 is open, the process in Step S101 is initiated again, and the attaching process is repeated. On the contrary, in the case of the judgment of normal completion of the attaching process in Step S102, the closed state of the cover 201 is confirmed in Steps S103 and S104.

After the confirmation, an optical checking process takes place in Step S105. This optical checking process is intended to judge whether or not the ink tanks normally attached in the precedent procedures are respectively fitted in proper positions (to be described in detail with reference to FIGS. 21B to 23D). After this optical checking process, a judgment is made in Step S106 as to whether or not this process is completed normally. In the case of the judgment of normal completion of the optical checking process, the process is terminated in Step S107 while turning green light on the indicator of the console unit 213, for example. On the contrary, in the case of the judgment that the process is not completed normally, the indicator of the console unit 213 is caused to blink in orange light in Step S109, for example. Then, in Step S110, the LED 101 of the ink tank not fitted in the proper position, which is specified in Step S105, is subjected to blinking or is turned on, for example. In this way, in Step S108, the user can recognize the ink tank which is not fitted in the proper position when the user opens the body cover 201. Accordingly, it is possible to urge the user to fit the relevant ink tank in the proper position.

Here, details of the ink attaching process in the above-described procedures will be described below.

Figure 18:
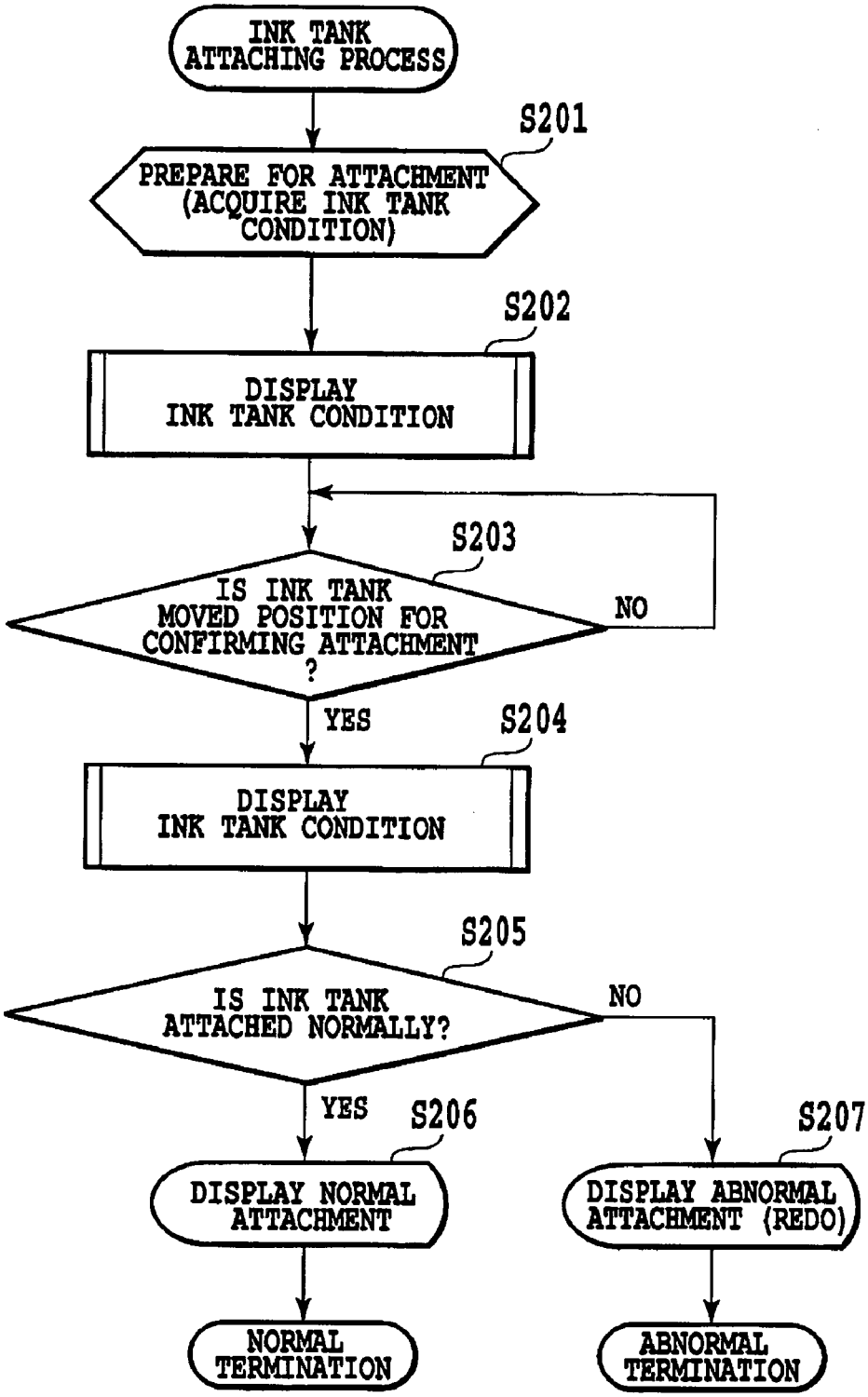
FIG. 18 is a flowchart showing details of the ink tank attaching process shown in FIG. 17.

FIG. 18 is a flowchart showing a detailed example of the ink tank attaching process. As shown in the drawing, in the attaching process, the CPU 301 on the printer body firstly acquires condition information on the respective ink tanks (individual information on the ink tanks) mounted thereon as an attachment preparation process (Step S201). Thereafter, a process for displaying conditions of the ink tanks is performed in Step S202.

Figure 19:
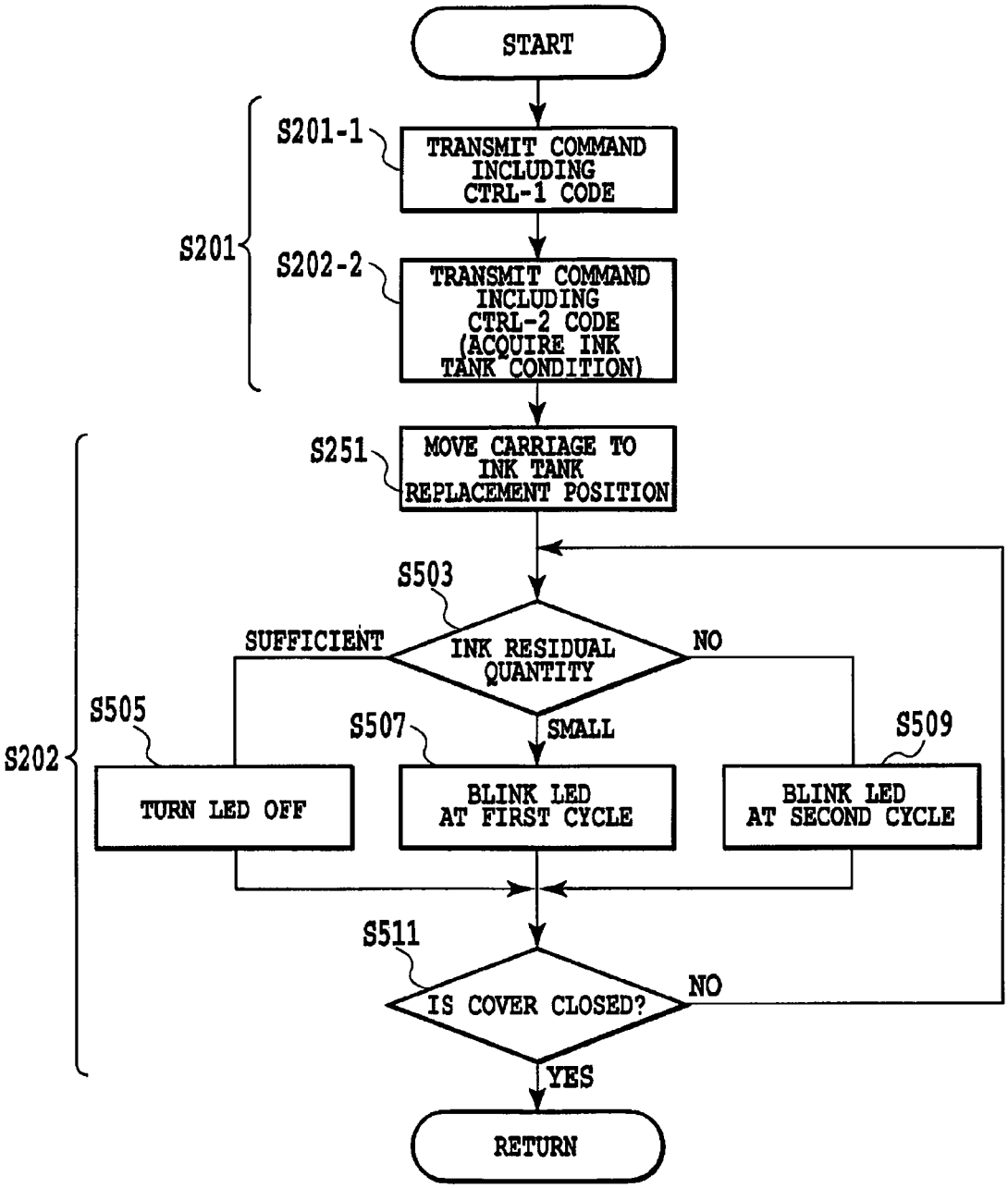
FIG. 19 is a flowchart showing a detailed example of an attachment preparation process and condition display control of the ink tank shown in FIG. 18.

FIG. 19 shows details of the attachment preparation process and the condition display process. Firstly, in Step S201-1, the control circuit 300 on the body transmits a command including the above-described "CTRL_1" code. The input and output control circuit 103A transfers desired condition information from the non-volatile memory 103B to the volatile memory 103D in response thereto. Subsequently, by transmitting a command including the "CTRL_2" code, the input and output control portion 103A reads the transferred information out of the volatile memory 103D and transmits the information to the control circuit 300. In this way, the control circuit 300 on the body can acquire the desired condition information from the volatile memories 103D of the respective ink tanks. The acquired condition information may include the ink residual quantity at that time, for example. Such information is read out of the volatile memory 103D together with the individual number of the ink tank. Reception of the command including the "CTRL_1" code and the command including the "CTRL_2" code establishes a mode of prohibiting access to the non-volatile memory 103B mounted on the control board of the ink tank.

Next, the carriage 205 is shifted to the tank replacement position (i.e. the position to allow the user to perform the detaching/attaching operation) (Step S501) Then, in response to the ink residual quantity of each of the ink tanks thus acquired, a command contained the drive control code for the LED 101 formed by adding the corresponding color information onto the top is transmitted in order to cause the relevant driving actions (Steps S503 to S509). The non-volatile memory 103B is not accessed when performing display along with reception of the commands (see FIGS. 15 and 16) including the codes for controlling the LED 101 to turn on/off.

For example, aspects of driving the LED 101 can be determined as follows. Specifically, in terms of the ink tank having the sufficient ink residual quantity, the LED 101 is not turned on in response to the ink residual quantity information "11" retained in the volatile memory 103D (Step S505). Meanwhile, in terms of the ink tank having the small ink residual quantity, the LED 101 is set to blinking at a predetermined first cycle in response to the ink residual quantity information "10" similarly (Step S507). Moreover, in terms of the ink tank having substantially no ink residual quantity, the LED 101 is set to blinking at a second cycle, which is different from the first cycle, in response to the ink residual quantity information "01" similarly (Step S509).

However, the aspects of driving the LED will not be limited only to the foregoing. It is by all means possible to determine the aspects as appropriate, or more specifically, to turn the LED 101 on when there is the sufficient ink residual quantity, for example. Alternatively, it is possible to perform control so as to light on only an LED of a newly attached ink tank. Specifically, the ink residual quantity information of the newly attached ink tank is set to "00" because no power has been supplied thereto. Accordingly, it is possible to carry out different display control (lighting only) from the case of any other ink residual quantity information. Moreover, in addition to the control in response to the above-described three levels of the ink residual quantity representing the state of the ink tank, it is also possible to perform control on two levels of whether there is substantially any ink residual quantity or not, or on four levels or more by dividing the ink residual quantity information into parts. In any case, it is effective to carry out blinking at different cycles depending on the multiple levels of the ink residual quantity.

Now, the user can detach the ink tank at arbitrary timing after visually checking the blink. Then, the power on the control portion 103 mounted on the board 120 of the ink tank is be suddenly shut down. In this case, the information stored in the volatile memory 103D disappears. However, since the non-volatile memory 103B is not accessed, it is possible to protect the information stored in the non-volatile memory 103B. Moreover, by performing the control for turning the LED 101 on and off while making reference to the volatile memory 103D, the user can recognize the most recent ink residual quantity while placing the carriage 205 in the ink tank replacement position. Moreover, the user can visually check appropriateness of the fitting condition of the new ink tank attached thereto.

Thereafter, when the user performs the replacing operation of the ink tank and closes the body cover 201 (Step S511), the process shown in FIG. 18 is resumed. Then, the carriage is moved to a position for confirming attachment of the ink tanks which is equivalent to a position opposed to the first light receiving portion 210 (Step S203), and control for confirming attachment of the ink tanks is executed (Step S204).

Figure 20:
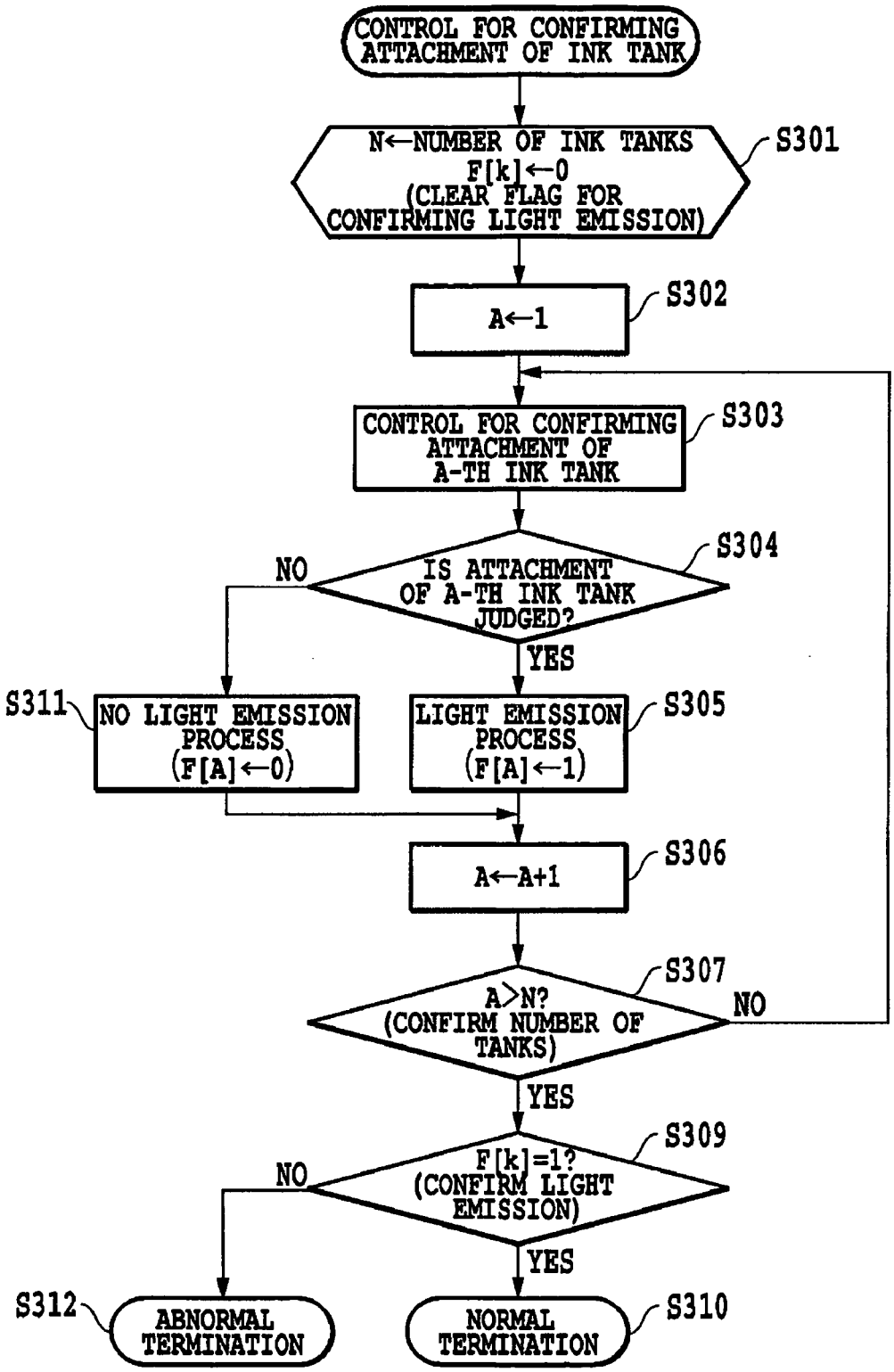
FIG. 20 is a flowchart showing a detailed example of attachment confirmation control in FIG. 18.

FIG. 20 is a flowchart showing details of the control for attachment confirmation. Firstly, in Step S301, a parameter N indicating the number of ink tanks to be mounted on the carriage 205 is set up and a flag F (k) for visually checking light emission of the LEDs in response to the number of the ink tanks is also initialized. In this embodiment, the parameter N is set to "4" so as to represent the number of the ink tanks for K, C, M, and Y. Accordingly, four flags of F (k): k=1 to 4 are prepared and all the contents thereof are initialized to "0."

Next, in Step S302, a variable A concerning the order for judging attachment of the ink tanks in each of the flags is set to "1." Then, attachment confirmation control is performed in terms of an A-th ink tank (which is the first ink tank in the beginning) in Step S303. This control is carried out in order to allow the user to confirm that the ink tank is fitted in the proper position of the holder 150 of the printing head unit 105. Specifically, when the contact 152 of the holder 150 is connected to the contact 102 of the ink tank, the control circuit 300 on the body designates the ink tank firstly by use of the color information representing the individual information on the ink tank as described previously. Thereafter, the color information stored in the memory array 103B of the designated ink tank is sequentially read out. Here, it is needless to say that the color information for specification is not used in terms of those which have been read out already. In addition, this control process also judges whether or not the color information thus read out is different from the color information which has been previously read out after starting this process.

Then, in Step S304, when the color information thus read out is different from the information which was previously read out, the judgment is made that the ink tank having the color information is attached as the A-th ink tank. In any other cases, the judgment is made that the A-th ink tank is not attached. Here, the A-th ink tank explained herein merely describes the order of judgment of the ink tank but does not represent the order indicating the position of attachment of the ink tank. When the judgment is made that the A-th ink tank is attached, the content of the relevant flag F (A), i.e. one of the four flags F (k): k=1 to 4 corresponding to the case where k=A, is set to "1" in Step S305. In this way, the LED 101 of the ink tank 1 having the relevant color information is turned on as described previously with reference to FIG. 16. When the judgment is made that the A-th ink tank is not attached, then, the content of the relevant flag F (A) is set to "0" in Step S311. Meanwhile, in the case of incomplete attachment where the contact 152 of the holder 150 is not connected to the contact 102 of the ink tank, the content of the flag F (A) is unchanged from "0."

Next, in Step S306, the variable A is incremented by 1. Then, a judgment is made in Step S307 as to whether or not this variable A is greater than the parameter N (which is equal to 4 in the case of the printer of this embodiment) set up in Step S301. Here, when the judgment is made that the variable A is equal to or below the parameter N, the processes starting from Step 303 are repeated. On the other hand, when the judgment is made that the variable A is greater than the parameter N, a judgment is made as to whether or not the contents of all the four flags F (k): k=1 to 4 are equal to "1," i.e. as to whether or not the LEDs 101 of all the ink tanks are turned on. When the judgment is made that the LED 101 of any of the ink tanks is not turned on, the status of the abnormal condition is returned to the process routine of FIG. 18 in Step S312 and then this process is terminated.

Figure 21A:
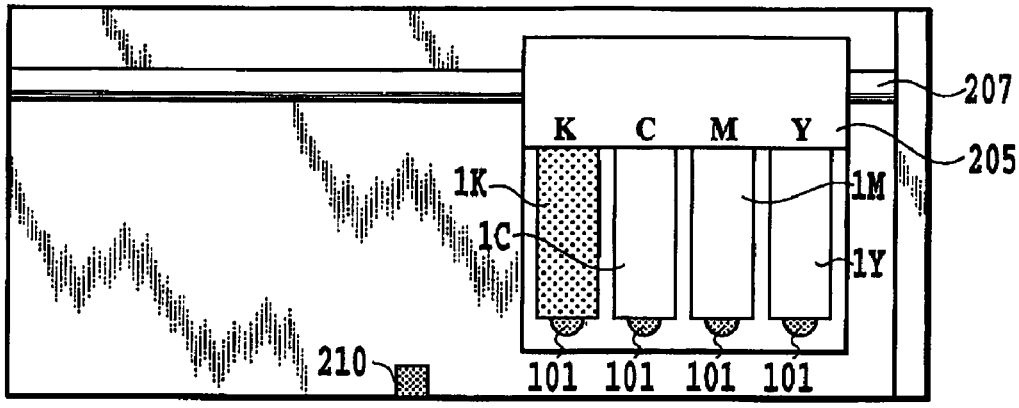

When the judgment is made that the LEDs of all the ink tanks are turned on, a normal terminating process is executed in Step S310 and then this process is terminated. Thereafter, the process returns to the process routine shown in FIG. 18. FIG. 21A is a view showing a state where all the ink tanks are properly attached and the respective LEDs are turned on.

Referring to FIG. 18 again, after executing the control for attachment confirmation in Step S203 as described above, a judgment is made in Step S204 as to whether or not the control is terminated normally, i.e. as to whether or not the ink tanks are attached normally. When the judgment is made that the ink tanks are attached normally, the indicator (see FIGS. 9 and 10) of the console unit 213 is lighted in green in Step S205, for example. Then, the process is normally terminated in Step S206 and returns to the process routine shown in FIG. 17. On the contrary, when the judgment is made that the ink tanks are attached abnormally, the indicator of the console unit 213 is lighted in orange in Step S207, for example. Then, the process is abnormally terminated in Step S208 and returns to the process routine shown in FIG. 17. When a host personal computer (PC) is connected for controlling the printing apparatus, it is also possible to perform abnormal attachment display through a PC monitor at the same time.

Here, when the ink tank attaching process is executed again while opening the body cover 201, it is possible to perform the blink control in terms of the LEDs of the properly attached ink tanks. In this way, it is possible to draw attention of the user to the followings: there is the ink tank that is not attached or not completely attached (that the contact 152 of the holder 150 is not connected to the contact 102 of the ink tank 1).

Next, a detailed example of the optical checking process (Step S105) in the procedures shown in FIG. 17 will be described.

The optical checking process judges whether or not each of the ink tanks, which is normally attached, is attached to the proper position. In light of the position to attach the ink tank, this embodiment does not adopt a configuration to form the respective ink tanks and the attachment positions into different shapes so as not to allow attachment of other types of ink tanks, and to define the attachment positions in terms of the ink tanks for the respective colors. Therefore, there is a risk that the ink tank for each color may be erroneously attached to an unexpected position. For this reason, the optical checking process is performed to inform the user of the erroneous attachment. In this way, it is possible to achieve manufacturing efficiency and cost reduction of the ink tanks without intentionally changing the shapes of the ink tanks depending on the ink colors.

Figure 21B:
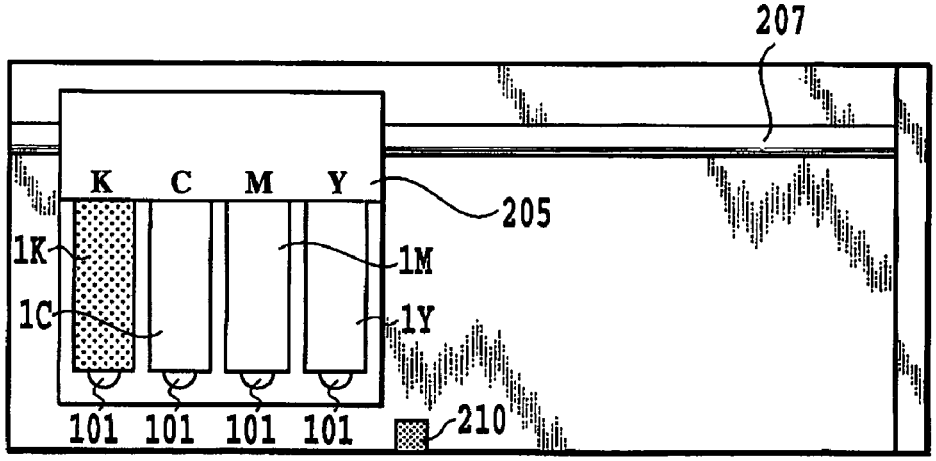

In the optical checking process, the closed state of the body cover 201 is confirmed (Steps S103 and S104 in FIG. 17). Then, as shown in FIG. 21B, the carriage 205 is firstly moved to the position for the optical check, and the lighted LEDs 101 corresponding to the respective ink tanks are turned off at the same time.

FIGS. 22A to 22D and FIGS. 23A to 23D are views for explaining subsequent procedures of the optical checking process.

Figure 22A:
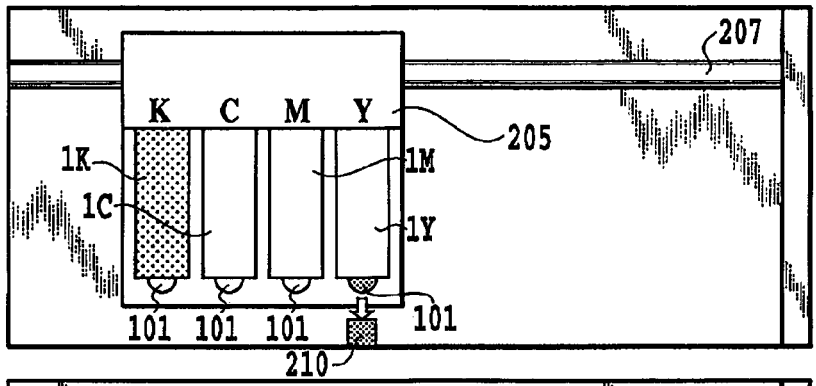
FIGS. 22A to 22D are views for explaining this optical checking process.

As shown in FIG. 22A, movement of the carriage 205 is started from the left side to the right side in the drawing relative to the first light receiving portion 210 to begin with. Then, a process to cause the LED 101 for the ink tank 1Y to emit the light is firstly performed at a position where the ink tank at a position to which the ink tank 1Y for the yellow ink should be attached, faces the first light receiving portion 210. In reality, this process is continued from the point of turning the light on to the point of turning the light off after passage of a predetermined time period as described with reference to FIG. 16. This rule applies similarly throughout the checking process. When the ink tank is fitted in the correct position, the first light receiving portion 210 can receive the light emitted from the LED 101, whereby the control circuit 300 judges that the ink tank 1Y is properly fitted in that attachment position.

Figure 22B:
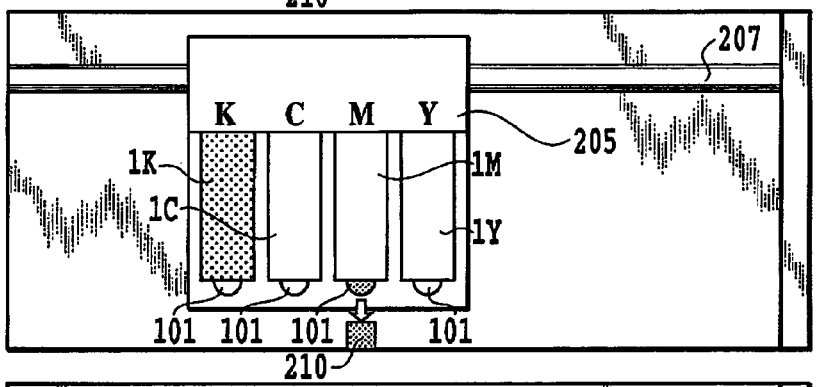
Figure 22C:
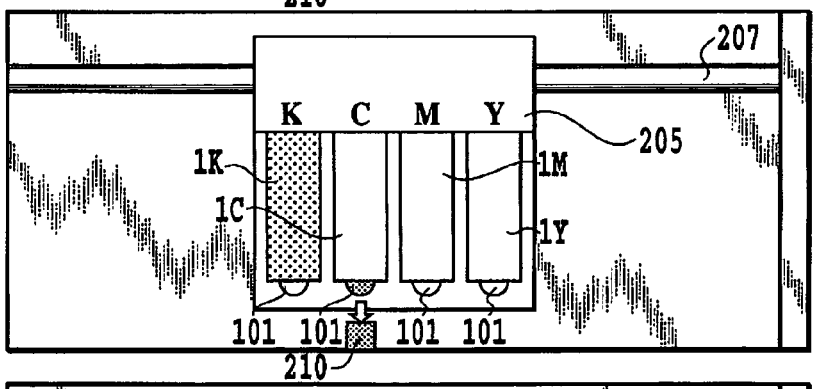
Figure 22D:
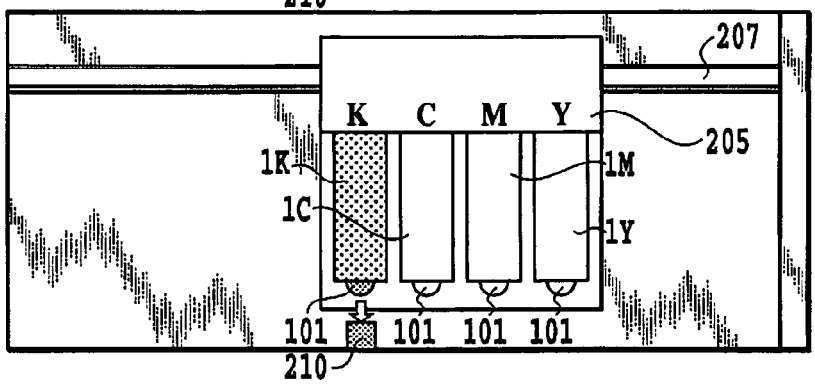

Similarly, as shown in FIG. 22B, the carriage 205 is moved and the LED 101 of the ink tank 1M is caused to emit the light at a position where the ink tank at a position to which the ink tank 1M for the magenta ink should be attached, faces the first light receiving portion 210. The example illustrated in the drawing shows an aspect in which the ink tank 1M is fitted in the correct position so that the first light receiving portion 210 receives the light emitted therefrom. Likewise, the light emission is executed similarly as shown in FIGS. 22B to 22D while changing the location subject to the judgment. These drawings show the example in which all the ink tanks are fitted in the correct positions.

Figure 23A:
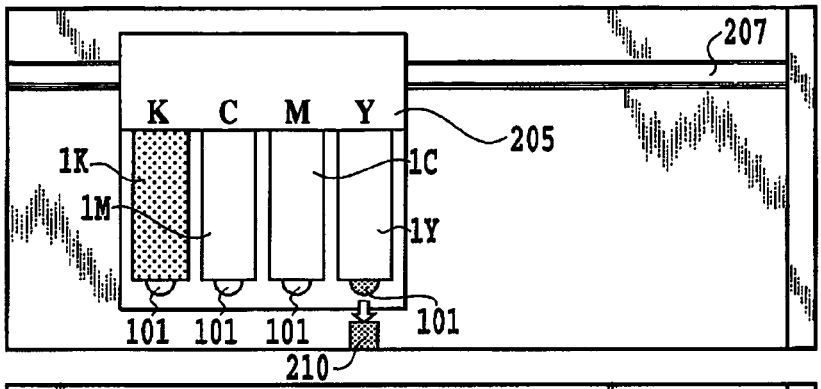
FIGS. 23A to 23D are more views for explaining the optical checking process.
Figure 23B:
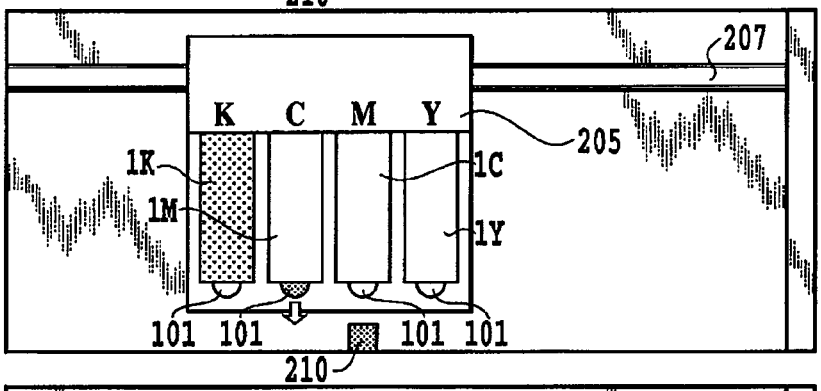
Figure 23C:
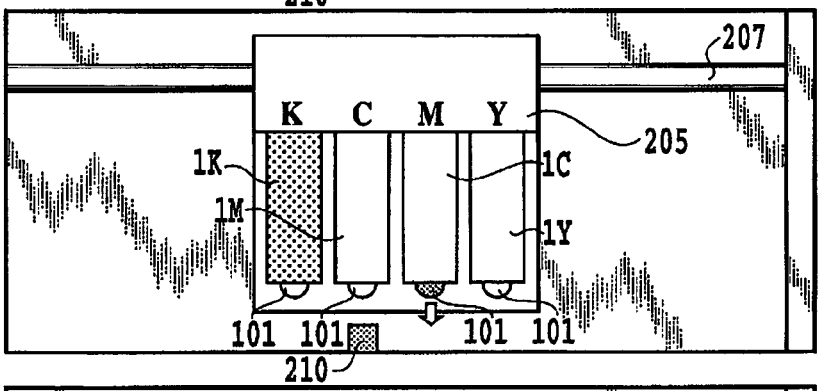
Figure 23D:
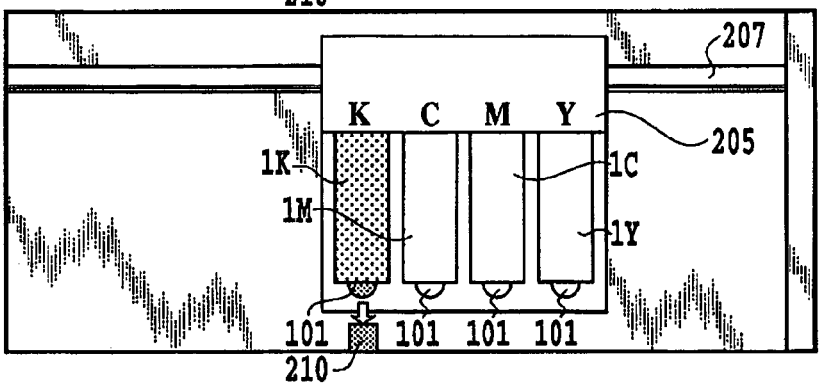

In the meantime, a case where the ink tank 1C for the cyan ink is erroneously fitted in the position supposed to attach the ink tank 1M for the magenta ink will be assumed as shown in FIG. 23B. In this case, the light is not emitted from the LED 101 of the ink tank 1C opposed to the first light receiving portion 210. Instead, the light is emitted from the LED 101 of the ink tank 1M which is mounted on a different location. As a result, at this timing, the first light receiving portion 210 cannot receive any light. Therefore, the control circuit 300 judges that the ink tank other than the ink tank 1M is fitted in this attachment position. On the contrary, the ink tank 1M for the magenta ink is erroneously fitted in the position supposed to attach the ink tank 1C for the cyan ink as shown in FIG. 23C. Here, the light is not emitted from the LED 101 of the ink tank 1M opposed to the first light receiving portion 210. Instead, the light is emitted from the LED 101 of the ink tank 1C which is mounted on a different location.

By executing the optical checking process as described above, the control circuit 300 can specify the ink tank which is not fitted to the expected position. Moreover, when the proper ink tank is not fitted in the expected position, it is possible to identify the color of the ink in the erroneously attached ink tank by performing control for sequentially causing the light emission from the three other ink tanks in that attachment positions. After the above-described optical checking process, the procedures starting from Step S106 described in FIG. 17 are executed.

In this way, the user can execute desired printing by use of the printer while fitting the proper ink tanks in the proper positions.

Figure 24:
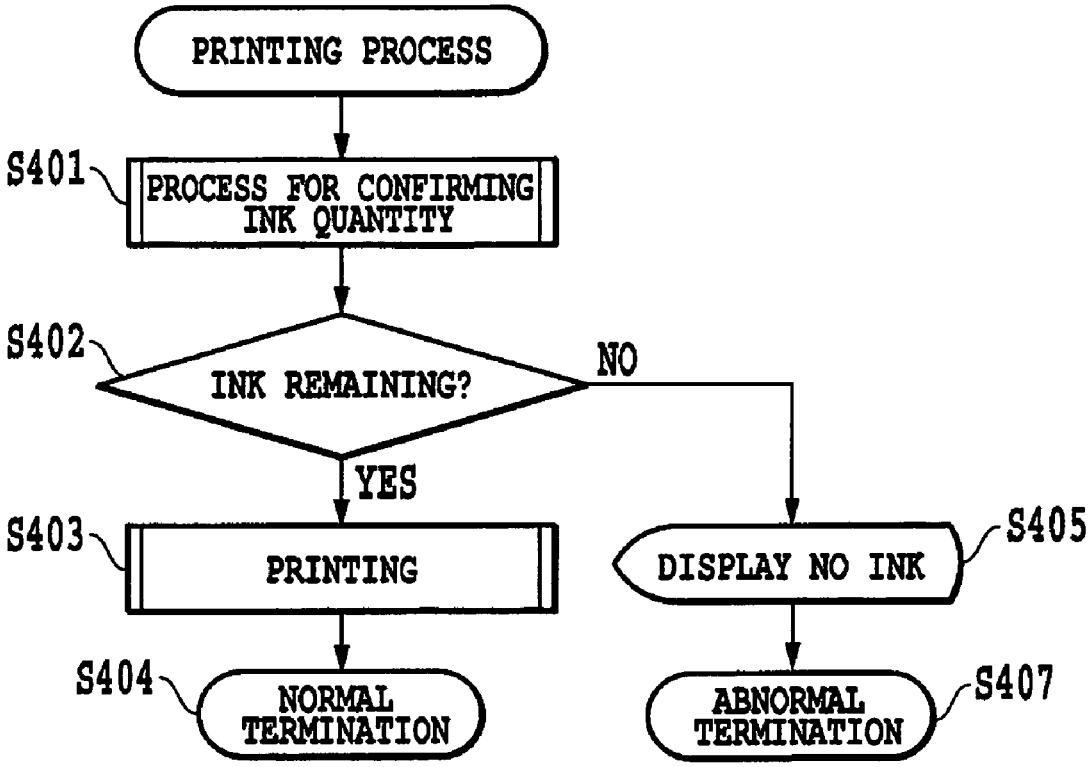
FIG. 24 is a flowchart showing a printing process in the embodiment.

FIG. 24 is a flowchart showing a printing process in this embodiment. In this process, an ink residual quantity confirmation process is firstly preformed in Step S401. This is the process of calculating a printing amount by use of printing data of a job to be printed from now, then comparing this amount with the residual quantity of each type of the ink, and then judging whether or not there is a sufficient amount of ink for printing that job. In this process, the above-described residual quantity may apply the value which is counted by the control circuit 300 as the residual quantity at that time.

In Step S402, a judgment is made as to whether or not there is the sufficient amount of ink based on the foregoing confirmation process. When there is the sufficient amount of the ink, a printing operation is executed in Step S403. Then, the indicator of the console unit 213 is lighted in green in Step S404 and the process is terminated normally. On the contrary, when the judgment is made in Step S402 that there is not the sufficient amount, the indicator of the console unit 213 is blinked in orange in Step S405 and the process is terminated abnormally. In this event, the user can initiate the procedures shown in FIG. 17 by opening the body cover 201.

According to the above-described configuration, even if the printing apparatus or a host computer for controlling the printing apparatus does not have a display function or if the user does not use such a function intentionally, the user can confirm the information on the ink tanks by use of the display functions embedded in the ink tanks. Moreover, as described above, the configuration of this embodiment is able not only to inform the lifetime and the timing for replacing the cartridge but also to inform the user of a variety of information including the information as to whether or not the cartridge is surely attached by use of the light emitting portion. In this way, the light emitting portion covers a variety of applications and has a broad range of application possibilities.

Figure 26:
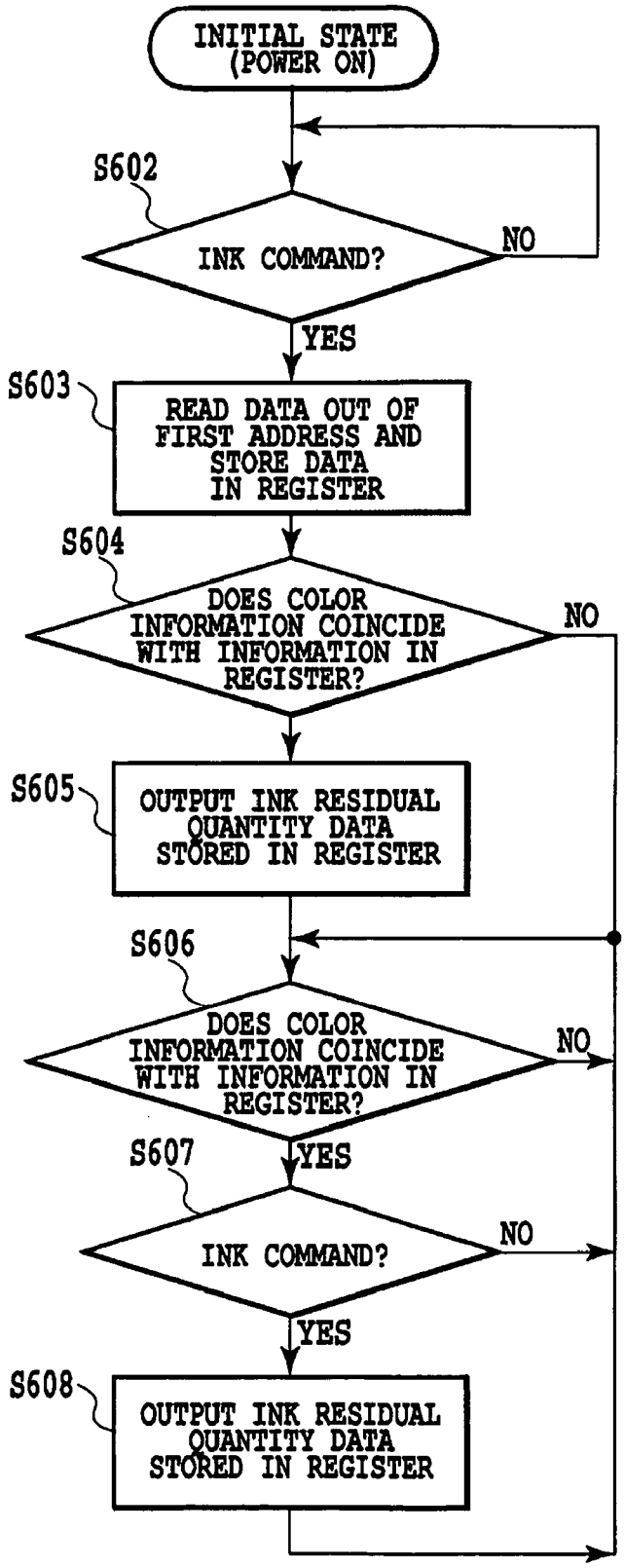
FIG. 26 is a flowchart showing an example of control procedures to be executed by an ink tank control portion according to the second embodiment of the present invention.
Figure 27:
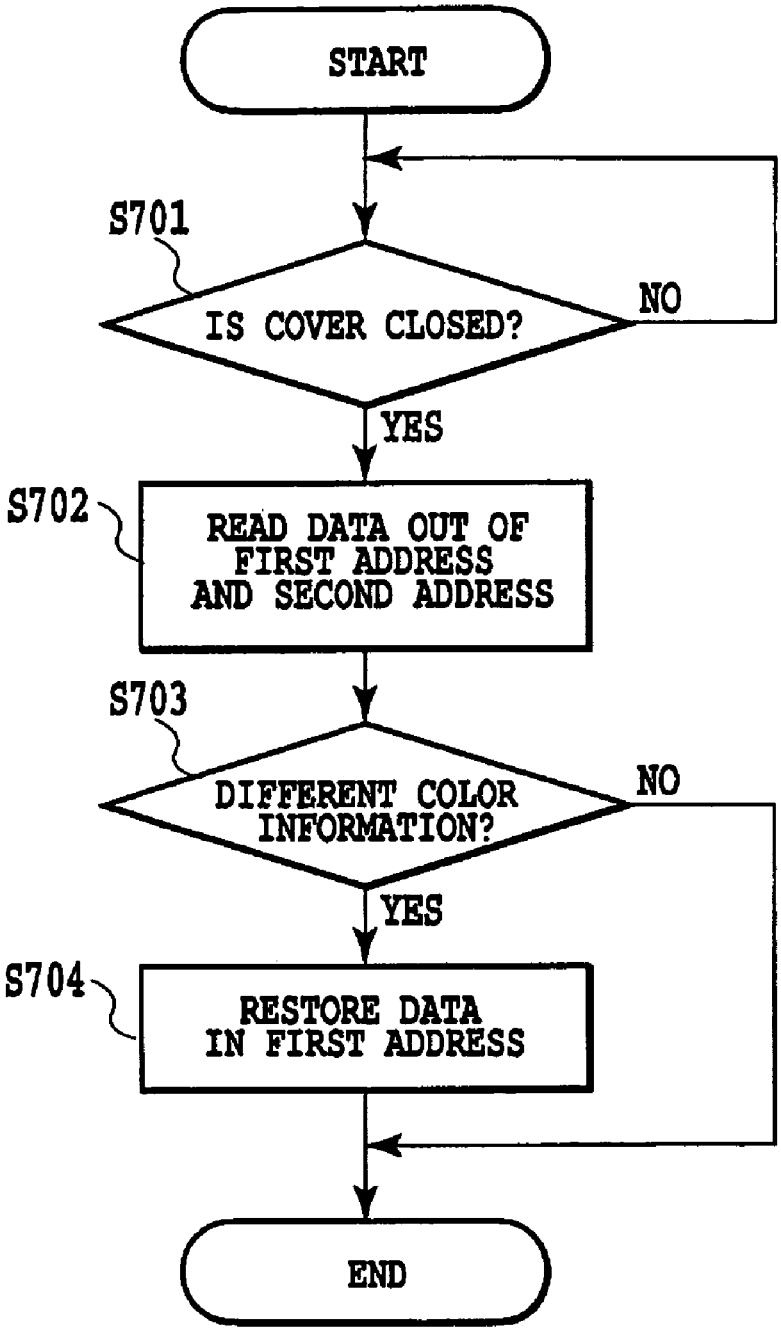
FIG. 27 is a flowchart showing an example of control procedures to be executed by a printer body side control circuit according to the second embodiment of the present invention.
Figure 28:
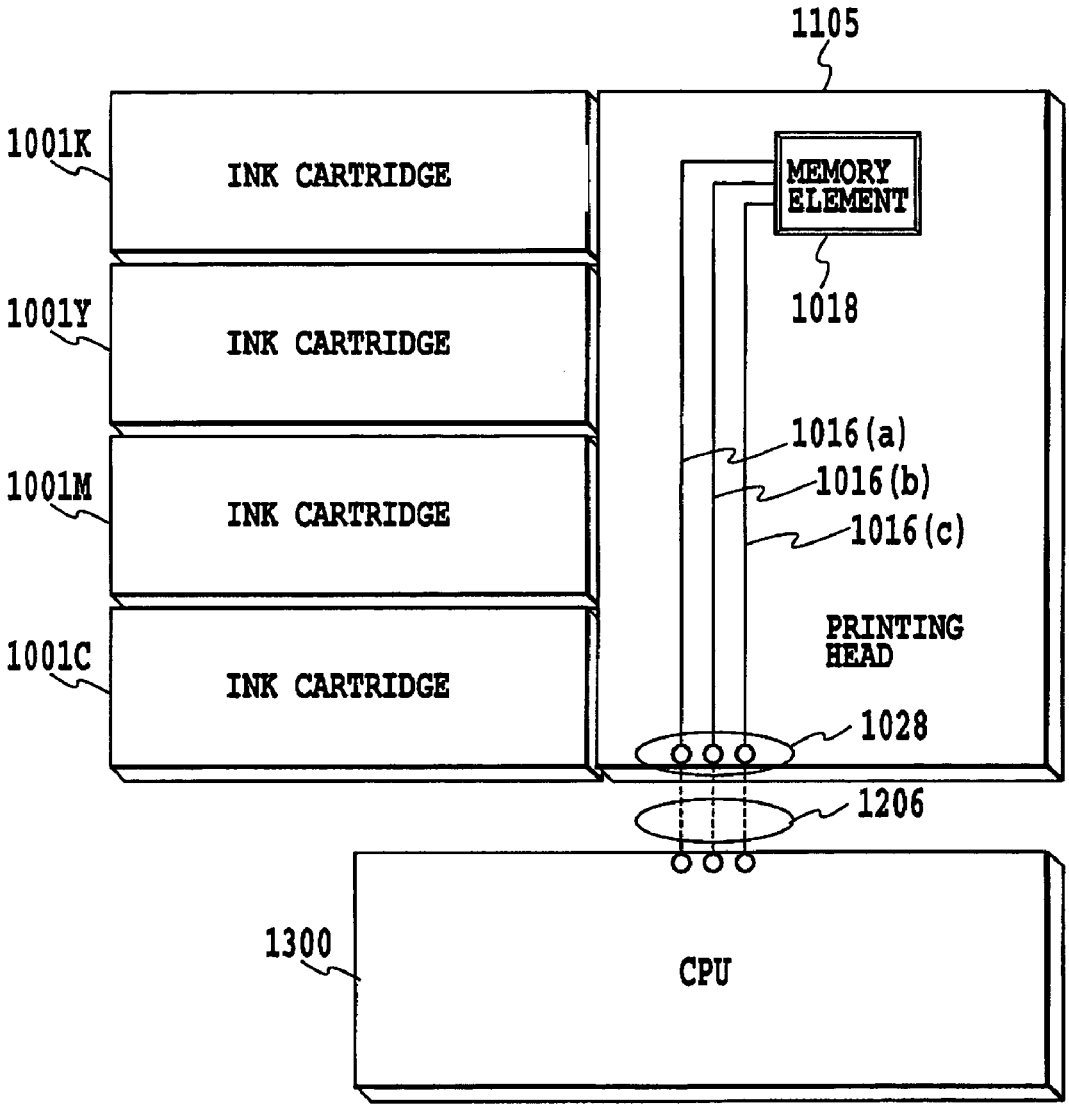
FIG. 28 is a block diagram schematically showing an example of a conventional aspect of connection among a printing head, ink tanks, and a printing apparatus.
Figure 29:
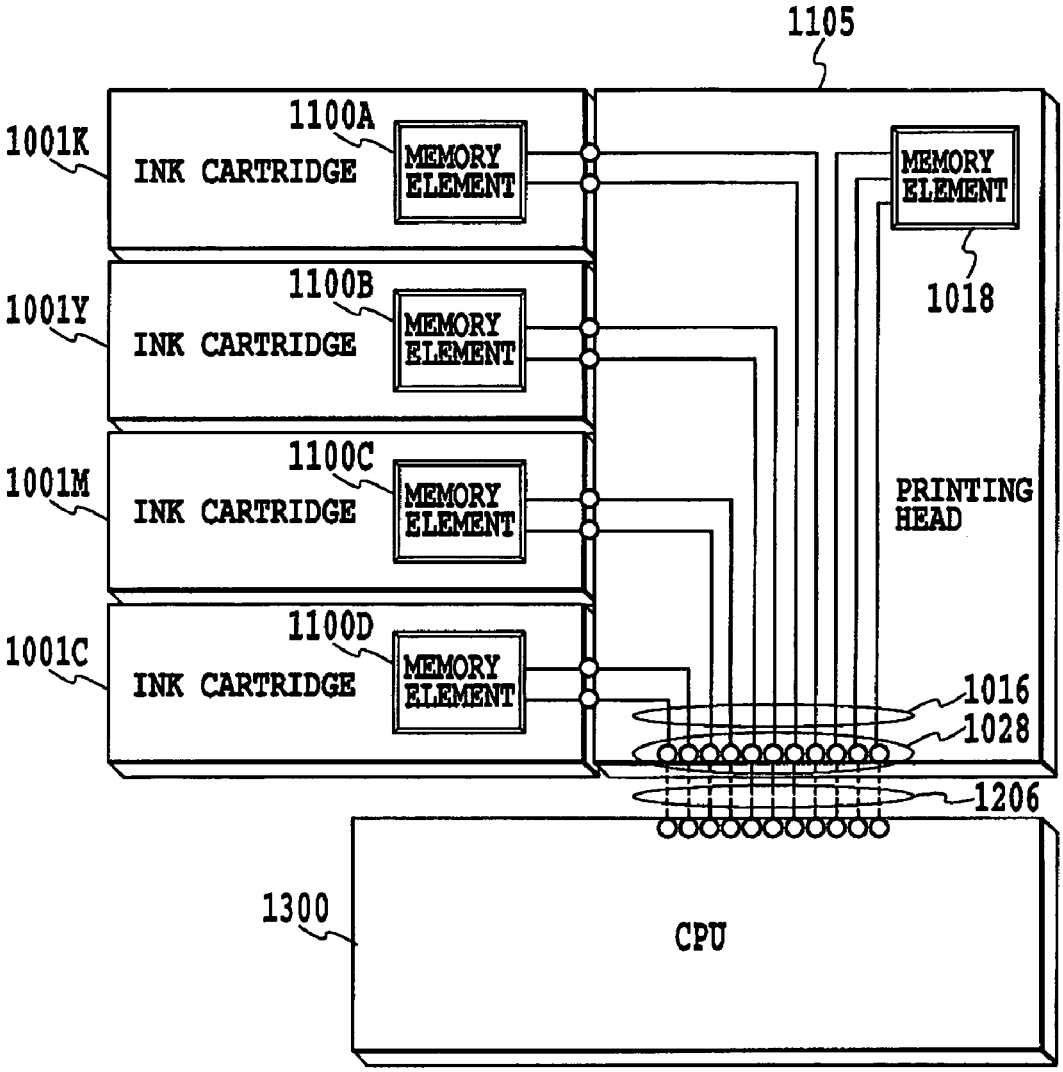
FIG. 29 is a block diagram schematically showing another example of a conventional aspect of connection among a printing head, ink tanks, and a printing apparatus.
Figure 30:
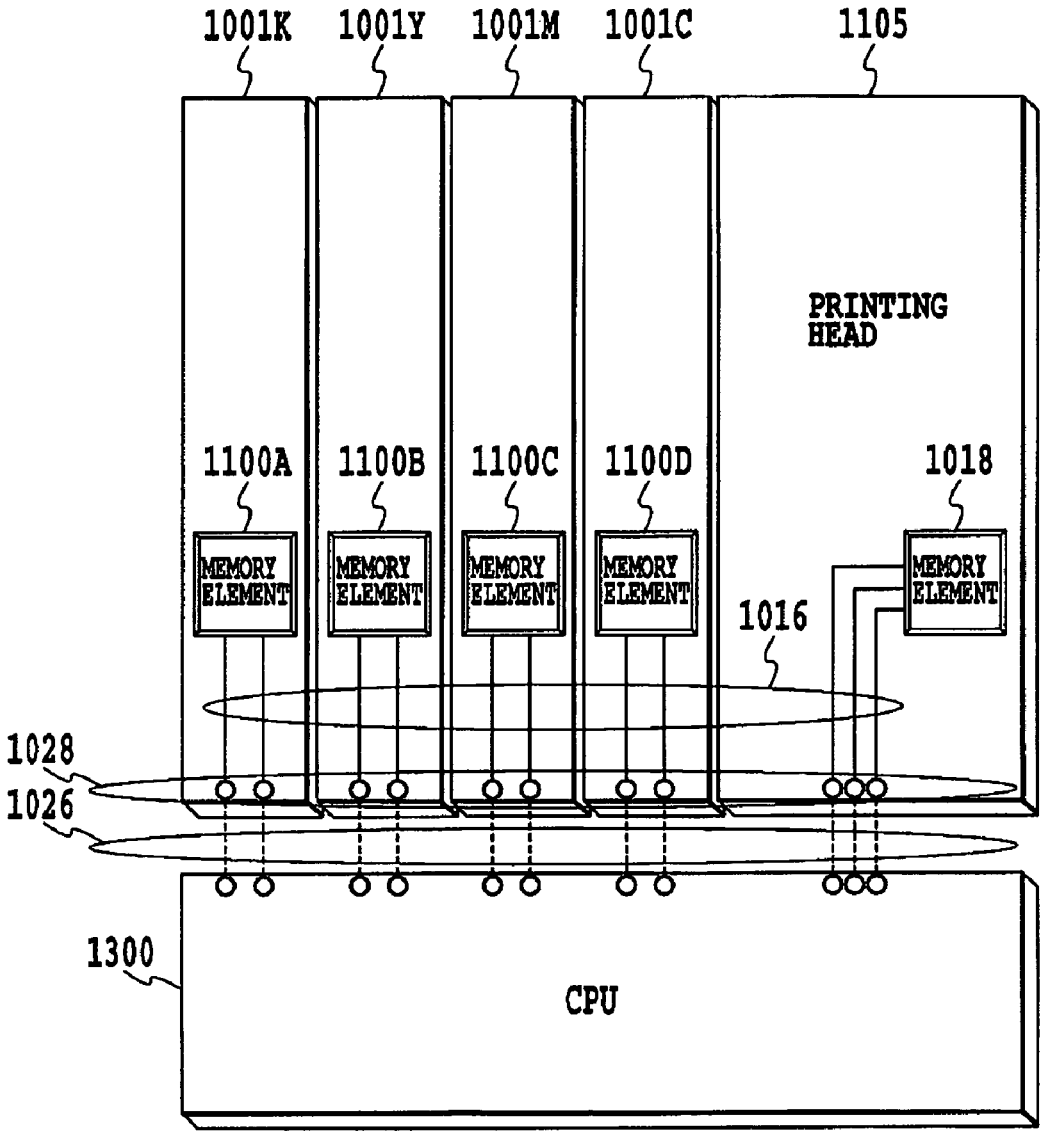
FIG. 30 is a block diagram schematically showing still another example of a conventional aspect of connection among a printing head, ink tanks, and a printing apparatus.

3. Second Embodiment (FIGS. 25 to 27)

Destruction of the content stored in the memory element and the memory element in itself due to hot-swap can be effectively prevented by the above-described embodiments. Moreover, the number of memory access can be reduced even in the case of using a non-volatile memory which has a limitation in the number of access. Accordingly, it is possible to extend the lifetime of the non-volatile memory and thereby to utilize reliable information for a long time period.

The next embodiment intends to further reduce the number of access to a non-volatile memory while utilizing the advantages attributed to the basic configuration of the first embodiment. Moreover, this embodiment is configured to read ink residual quantity at the time of attaching an ink tank and to perform display in response thereto. In addition, this embodiment is configured to recover data in the event of destruction of the data such as the ink residual quantity stored in a non-volatile memory.

Figure 25:
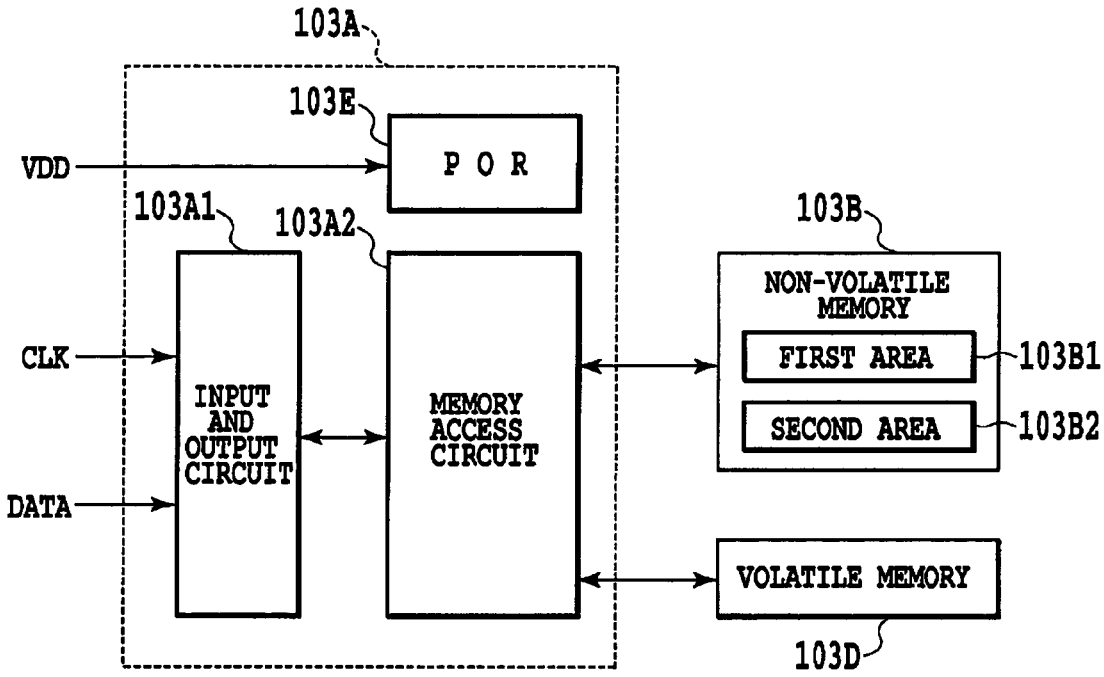
FIG. 25 is a view schematically showing a non-volatile memory, a volatile memory, and in particular, a portion of an input and output control circuit used for controlling memory access according to a second embodiment of the present invention.

FIG. 25 is a view schematically showing a non-volatile memory, a volatile memory, and in particular, a portion of an input and output control circuit used for controlling memory access according to a second embodiment of the present invention. In the drawing, constituents having similar functions to those in the foregoing embodiment are denoted by the same reference numerals.

In FIG. 25, reference numeral 103A1 denotes an input and output circuit in the input and out put control circuit 103A, which performs transmission and reception of data (DATA) synchronously with a clock (CLK) to be outputted from the control circuit 300 on the body. Reference numeral 103A2 denotes a memory access control portion which interprets a command transmitted from the control portion 300 on the body and controls access to the non-volatile memory 103B and to the volatile memory 103D. A power-on-reset (POR) circuit 103E generates a pulse signal for initializing the control portion only once when electric power to be supplied from the body through the signal line VDD is turned on. The non-volatile memory 103B includes first and second address areas 103B1 and 103B2 in this embodiment. The same pieces of information (the color information and data indicating the ink residual quantity) are respectively retained by these address areas. Here, these address area may be formed separately by dividing a memory area on a single memory chip. Alternatively, it is also possible to form the address areas separately on two memory chips.

In this embodiment, "READ" and "WRITE" codes for defining similar operations to those shown in FIG. 15, and an "INK" code for instructing to perform a reading operation of the ink residual quantity are used as the "control codes" concerning the memory access.

FIG. 26 is a flowchart showing an example of procedures in response to an ink residual quantity read command by the control portion 103 on the tank. These procedures are positioned as processes to be executed by the control portion on each of the ink tanks which are associated with display control (similar control to Steps S503 to S509 in FIG. 19) in response to the ink residual quantity. However, in this embodiment, the codes "CTRL_1" and "CTRL_2" are not used for the attaching preparing process. Instead, an operation is defined by a command including the "INK" code.

In FIG. 26, when the ink tank is attached to the holder 150, the power is supplied from the printer body through the signal line VDD. Accordingly, the control portion 103 is reset to the initial state by the POR circuit 103E.

In the ink tank replacement position, commands including the "INK" codes for the respective ink tanks are periodically transmitted from the control circuit 300 on the printer body to the ink tanks in order to perform display based on the ink residual quantity. In Step S602, each of the ink tanks analyzes whether any "INK" code is included without limitation to the code related to its own color information. Upon an affirmative judgment, in Step S603, the color information and the data indicating the ink residual quantity are read out of the first address area 103B1 of the non-volatile memory 103B and are stored in the volatile memory 103D functioning as the register. Next, a judgment is made in Step S604 as to whether or not the color information stored in the volatile memory 103D coincides with the "color information" attached to the command including the "INK" code. When the judgment is made that the both pieces of the color information coincide with each other, the ink residual quantity data stored in the volatile memory 103D are transmitted from the input and output circuit 102 to the body in Step S605.

Regarding a subsequent command from the control circuit 300 on the body, the color information in the command is firstly compared with the color information in the volatile memory 103D in Step S606. Then, the control code is judged in Step S607 only when the both pieces of the color information coincide with each other. When the command includes the "INK" code, the ink residual quantity data in the volatile memory 103D are transmitted to the body in Step S608.

The control circuit 300 on the body transmits a command including a control code for an operation to turn the LED 101 on and off (inclusive of a blinking operation). When a user sees display in response to this command, the user can perform the operation to replace the ink tank. Recognition of the ink residual quantity as a premise of that operation is performed based on the data acquired from the volatile memory 103D. Therefore, in the state where it is possible to perform the operation to replace the ink tank, there is very little chance of access to the non-volatile memory 103B. Accordingly, even if the user detaches the ink tank, there is very little risk of destruction of the contents stored in the non-volatile memory 103B and the memory in itself. Moreover, in this embodiment, the non-volatile memory 103B is accessed only once immediately after supplying the power. Therefore, it is possible to drastically reduce the number of access to the non-volatile memory.

Furthermore, in this embodiment, the desired data (the ink residual quantity data) in the first address area of the non-volatile memory 103B are stored in the volatile memory 103D functioning as the register at the initial stage when the ink tank is attached and the power is supplied. Therefore, in addition to the display for simply indicating attachment of the ink tank, it is possible to perform the display based on the ink residual quantity data in the volatile memory 103D promptly when the originally attached ink tank is detached once and re-attached again, for example.

FIG. 27 is a flowchart showing an example of memory control procedures to be executed by the control circuit 300 on the body after reading the ink residual quantity and performing the display based thereon. These procedures can be inserted as a process after Step S202 shown in FIG. 18.

Firstly, the condition of the body cover 201 is checked in Step S701, whereby a judgment is made as to whether or not the body cover 201 is closed so as not to cause unintentional detachment of the ink tank. Here, upon an affirmative judgment, the color information and the ink residual quantity data stored in the first address area 103B1 and in the second address area 103B2 of the non-volatile memory 103B are read out in Step S702 by use of a command including the "READ" code. Next, the both pieces of color information data are compared in Step S703. When the pieces of the color information data do not coincide with each other, a judgment is made that the data in the first address area 103B1 are destroyed. Accordingly, in Step S704, the data (the color information and the ink residual quantity data) in the first address area 103B1 are restored based on the second address area 103B2.

These procedures can recover the data even if the ink tank is unintentionally detached in the course of data transfer in the above-described Step S603, i.e. when accessing the first address area 103B1. Moreover, in the case of using a memory of a so-called destructive readout type suitable to reducing the memory chip size, it is also possible to recover the data if the data in the first address area 103B1 are deleted. Now, by recovering the data in the first address area 103B1 as described above, it is possible to store the correct ink residual quantity data in the volatile memory 103D functioning as the register when the ink tank is detached and attached again or when the device is turned on.

Here, it is also possible to calculate or detect the ink residual quantity as appropriate in a different cycle when closing the cover, and to transmit a command including the "WRITE" code and the address data stored in second address area 103B2, for example. That is, it is possible to update the ink residual quantity data in terms of the second address area 103B2.

4. Others

The above-described embodiments apply the LED as the light emitting portion for informing the condition of the ink tank. However, it is possible to apply other types of lamps. Meanwhile, in addition to those designed for simple light emission, it is also possible to apply a display portion such as a liquid crystal display element which is configured to indicate desired information by use of characters and graphics, for example. Moreover, in addition to those configured to emit the light, it is also possible to use other components which perform informing in the form of displacement, deformation or discoloration. In addition, it is also possible to use other components which perform informing by stimulating other human senses such as the auditory perception in the use of beep sound or the like, instead of stimulating the visual perception. In other words, the informing is not limited only to a visual effect, and it is satisfactory as long as the informing is achieved by stimulating other human senses. Therefore, it is possible to apply various types of informing portions as appropriate. In any case, it is preferable to perform an appropriate informing so that the user can specify the respective ink tanks mounted on the printer and that the user can also specify various conditions of the ink tanks.

Moreover, the embodiments describe the configuration of the ink tank holder in the form of the printing head cartridge that integrates the printing head unit. However, the ink tank holder is not limited only to this configuration. Specifically, it is possible to provide the ink tank holder independently from the printing head as long as the ink tank is rendered capable of supplying the ink to the printing head by way of ink communication upon attachment of the ink tank.

Furthermore, the number of the ink tanks and the holders, the aspect of containing the ink, and the structures of the printing head unit and the ink jet printing apparatus for attaching the ink tanks are not limited only to the foregoing explanations. In addition, the color tone of the inks used therein may be monochrome or multicolor. Moreover, addition to use the ink as a coloring material, it is also possible to utilize the ink tank for containing a processing liquid for improving color fixation, color appearance or durability on a printing medium, for example.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application No. 2004-374487 filed Dec. 24, 2004, which is hereby incorporated by reference herein.

What is claimed is:

1. A liquid container detachably mountable on a printing apparatus, wherein the printing apparatus is constructed to mount at least one such liquid container and includes a device side contact electrically connectable to a container side contact formed on the liquid container and an electric circuit having wiring for achieving common electrical connection between the respective container side contacts on the mounted liquid containers and the device side contacts, the liquid container comprising:

the container side contact electrically connectable to the device side contact;

a non-volatile information retention portion provided on the liquid container and constructed to retain information pertaining to the liquid container;

a volatile information retention portion provided on the liquid container and constructed to retain at least part of the information retained by the non-volatile retention portion;

an informing portion;

a drive portion for driving the informing portion; and a control portion constructed to control any of access to the non-volatile information retention portion, access to the volatile information retention portion, and drive of the informing portion by use of the drive portion to inform a condition of the liquid container, upon receipt of a command including individual information from the printing apparatus.

2. The liquid container according to claim 1, wherein the non-volatile information retention portion, the volatile information retention portion, the informing portion, the drive portion, and the control portion, which are provided on the liquid container, are disposed on a single circuit board.

3. The liquid container according to claim 1, wherein the informing portion is a light emitting portion.

4. The liquid container according to claim 1, wherein the liquid container contains ink.

5. The liquid container according to claim 1, wherein the information includes condition information for indicating the condition of the liquid container, and at least the condition information is retained by the volatile information retention portion provided on the liquid container.

6. The liquid container according to claim 5, wherein the condition information represents residual quantity of a liquid contained in the liquid container.

7. The liquid container according to claim 5, wherein the printing apparatus is constructed to mount a plurality of the liquid containers, and the information retained by the respective volatile information retention portions provided on the plurality of liquid containers further includes individual information pertaining to its own liquid container.

8. The liquid container according to claim 5, wherein the control portion has a mode for controlling the drive of the informing portion based on the condition information retained in the volatile information retention portion provided on the liquid container without accessing the non-volatile information retention portion.

9. The liquid container according to claim 8, wherein at least the condition information in the non-volatile information retention portion is transferred to the volatile information retention portion provided on the liquid container before carrying out the mode.

10. A printing apparatus constructed to mount the liquid container according to claim 8, the printing apparatus comprising:

means for transmitting a command including a code for setting up the mode;

means for transmitting a command including a code for instructing to access to the volatile information retention portion provided on the liquid container after the transmission; and means for transmitting a command including a code for controlling drive of the informing portion based on the conditional information acquired from the volatile information retention portion in response to the access.

11. The liquid container according to claim 5, wherein the control portion performs at least any of acquiring and updating the condition information by receiving a command inputted from the printing apparatus for accessing the non-volatile information retention portion or the volatile information retention portion.

12. A printing apparatus constructed to mount the liquid container according to claim 11, the printing apparatus comprising means for transmitting a command including a code for accessing the non-volatile information retention portion or the volatile information retention portion provided on the liquid container.

13. The liquid container according to claim 5, wherein the non-volatile information retention portion has a first and a second information retention portions.

14. The liquid container according to claim 13, wherein the condition information retained by the first retention portion is transferred to the volatile information retention portion provided on the liquid container in response to input of a code for allowing the printing apparatus to acquire the condition information when there is power supplied to the liquid container, and the drive of the informing portion is controlled based on the condition information retained by the volatile information retention portion upon subsequent input of the code.

15. A printing apparatus constructed to mount the liquid container according to claim 14, the printing apparatus comprising means for transmitting a command including a code for acquiring the conditional information.

16. A liquid container detachably mountable on a printing apparatus, wherein the printing apparatus is constructed to mount at least one such liquid container and includes a device side contact electrically connectable to a container side contact formed on the liquid container and an electric circuit having wiring for achieving common electrical connection between the respective container side contacts on the mounted liquid containers and the device side contacts, the liquid container comprising:

the container side contact electrically connectable to the device side contact;

a non-volatile information retention portion provided on the liquid container and constructed to retain information pertaining to the liquid container;

a volatile information retention portion provided on the liquid container and constructed to retain at least part of the information retained by the non-volatile retention portion;

an informing portion;

a drive portion for driving the informing portion; and a control portion constructed to control any of access to the non-volatile information retention portion, access to the volatile information retention portion, and drive of the informing portion by use of the drive portion to inform a condition of the liquid container, upon receipt of a command including individual information from the printing apparatus, wherein the information includes condition information for indicating the condition of the liquid container, and at least the condition information is retained by the volatile information retention portion provided on the liquid container, wherein the non-volatile information retention portion has a first and a second information retention portions, and wherein the information is retained respectively in the first and second information retention portions, the information are compared with each other at a predetermined timing, and the information in the first information retention portion is rewritten based on the information retained in the second information retention portion when the information are different from each other.

17. A circuit board provided on a liquid container detachably mountable on a printing apparatus, wherein the printing apparatus is constructed to mount at least one such liquid container and includes a device side contact electrically connectable to a contact formed on the liquid container and an electric circuit having wiring for achieving common electrical connection between the respective contacts on the mounted liquid containers and the device side contacts, the circuit board comprising:

the contact electrically connectable to the device side contact;

a non-volatile information retention portion provided on the circuit board and constructed to retain information pertaining to the liquid container;

a volatile information retention portion provided on the circuit board and constructed to retain at least part of the information retained by the non- volatile information retention portion;

a drive portion for driving an informing portion; and a control portion constructed to control any of access to the non-volatile information retention portion, access to the volatile information retention portion, and drive of the informing portion by use of the drive portion to inform a condition of the liquid container, upon receipt of a command including individual information from the printing apparatus.

18. The circuit board according to claim 17, wherein the informing portion is integrally arranged on the board.

19. A liquid supply system comprising:

a printing apparatus constructed to mount at least one ink container and including a device side contact electrically connectable to a contact formed on the liquid container and an electric circuit having wiring for achieving common electrical connection between the respective contacts on the mounted ink containers and the device side contacts; and an ink container detachably mounted on a carriage of the printing apparatus, the ink container having:

the contact electrically connectable to the device side contact;

a non-volatile information retention portion provided on the ink container and constructed to retain information pertinent to the ink container;

a volatile information retention portion provided on the ink container and constructed to retain at least part of the information retained by the nonvolatile information retention portion;

an informing portion;

a drive portion for driving the informing portion; and a control portion constructed to control any of access to the non-volatile information retention portion, access to the volatile information retention portion, and drive of the informing portion by use of the drive portion to inform a condition of the liquid container, upon receipt of a command including individual information from the printing apparatus.

20. A printing apparatus constructed to detachably mount at least one liquid container, said printing apparatus including a device side contact electrically connectable to a container side contact formed on the liquid container and an electric circuit having wiring for achieving common electrical connection between the respective container side contacts on the mounted liquid containers and the device side contacts, the liquid container comprising the container side contact electrically connectable to the device side contact, a non-volatile information retention portion provided on the liquid container and constructed to retain information pertaining to the liquid container, a volatile information retention portion provided on the liquid container and constructed to retain at least part of the information retained by the non-volatile retention portion, an informing portion, a drive portion for driving the informing portion, and a control portion constructed to control any of access to the non-volatile information retention portion, access to the volatile information retention portion, and drive of the informing portion by use of the drive portion to inform a condition of the liquid container, upon receipt of a command including individual information from the printing apparatus, wherein the information includes condition information for indicating the condition of the liquid container, and at least the condition information is retained by the volatile information retention portion provided on the liquid container, wherein the non-volatile information retention portion has a first and a second information retention portions, and wherein the information is retained respectively in the first and second information retention portions, the information are compared with each other at a predetermined timing, and the information in the first information retention portion is rewritten based on the information retained in the second information retention portion when the information are different from each other, the printing apparatus comprising:

means for accessing to the first and second information retention portions at a predetermined timing and comparing the information retained therein with each other; and means for causing the rewrite of the information in the first information retention portion based on the information retained in the second information retention portion when the information are different from each other.

* * * * *